US007442286B2

(12) United States Patent
Capper et al.

(10) Patent No.: US 7,442,286 B2
(45) Date of Patent: Oct. 28, 2008

(54) ARTICLES WITH ELECTROPLATED ZINC-NICKEL TERNARY AND HIGHER ALLOYS, ELECTROPLATING BATHS, PROCESSES AND SYSTEMS FOR ELECTROPLATING SUCH ALLOYS

(75) Inventors: Lee Desmond Capper, Wolverhampton (GB); Vincent C. Opaskar, Chagrin Falls, OH (US); Paul Christopher Wynn, Staffordshire (GB); Craig V. Bishop, Fort Mill, SC (US)

(73) Assignee: Atotech Deutschland GmbH, Berlin (DE)

( * ) Notice: Subject to any disclaimer, the term of this patent is extended or adjusted under 35 U.S.C. 154(b) by 498 days.

(21) Appl. No.: 10/789,175

(22) Filed: Feb. 26, 2004

(65) Prior Publication Data

US 2005/0189231 A1 Sep. 1, 2005

(51) Int. Cl.
*C25D 3/56* (2006.01)

(52) U.S. Cl. ..... 205/246

(58) Field of Classification Search ..... 205/246
See application file for complete search history.

(56) References Cited

U.S. PATENT DOCUMENTS

| | | | | |
|---|---|---|---|---|
| 4,060,506 A | | 11/1977 | Verbanac | 260/17.4 |
| 4,285,802 A | | 8/1981 | Rynne | 204/43 |
| 4,417,956 A | | 11/1983 | McCoy | 204/44 |
| 4,469,564 A | | 9/1984 | Okinaka et al. | 204/15 |
| 4,572,768 A | * | 2/1986 | Wolski et al. | 205/111 |
| 4,581,107 A | * | 4/1986 | Irie et al. | 205/155 |
| 4,652,351 A | | 3/1987 | Vaughan | 204/105 |
| 4,765,871 A | | 8/1988 | Hsu et al. | 204/44.2 |
| 4,772,362 A | | 9/1988 | Martin et al. | 204/44.2 |
| 4,861,442 A | | 8/1989 | Nishihama et al. | 204/44.2 |
| 4,877,496 A | * | 10/1989 | Yanagawa et al. | 205/246 |
| 4,889,602 A | | 12/1989 | Oshima et al. | 204/38.1 |

(Continued)

FOREIGN PATENT DOCUMENTS

EP 0 649 918 B1 11/1996

(Continued)

OTHER PUBLICATIONS

Osetrova, "Use of Ethylenediamine in Electroplating", Sbornik Nauchnykh Trudov—Institut Tsvetnykh Metallov im. M. I. Kalinina (no month, 1960), vol. 33, pp. 396-399. Abstract Only.*

(Continued)

*Primary Examiner*—Edna Wong
(74) *Attorney, Agent, or Firm*—Renner, Otto, Boisselle & Sklar, LLP

(57) ABSTRACT

An electroplating bath, a system, a process for, and the article obtained from, depositing a zinc-nickel ternary or higher alloy, a) zinc ions; b) nickel ions; and c) one or more ionic species selected from ions of $Te^{+4}$, $Bi^{+3}$ and $Sb^{+3}$, and in some embodiments, further including one or more additional ionic species selected from ions of $Bi^{+3}$, $Sb^{+3}$, $Ag^{+1}$, $Cd^{+2}$, $Co^{+2}$, $Cr^{+3}$, $Cu^{+2}$, $Fe^{+2}$, $In^{+3}$, $Mn^{+2}$, $Mo^{+6}$, $P^{+3}$, $Sn^{+2}$ and $W^{+6}$. In some embodiments, the system includes a divider forming a cathodic chamber and an anodic chamber, with the electroplating bath in the cathodic chamber only. In various embodiments, the zinc-nickel ternary and higher alloys may provide improved properties to the conductive substrates upon which the alloys are deposited.

29 Claims, 1 Drawing Sheet

ATOTP0109

U.S. PATENT DOCUMENTS

| | | | | |
|---|---|---|---|---|
| 4,898,652 | A | 2/1990 | Bammel et al. | 204/44.2 |
| 4,983,263 | A | 1/1991 | Yasuda et al. | 204/44.2 |
| 5,003,022 | A | 3/1991 | Nguyen et al. | 527/300 |
| 5,032,236 | A | 7/1991 | Saitou et al. | 204/27 |
| 5,147,907 | A | 9/1992 | Rinck et al. | 524/48 |
| 5,304,403 | A | 4/1994 | Schlesinger et al. | 427/437 |
| 5,405,523 | A | 4/1995 | Eckles | 205/245 |
| 5,416,181 | A | 5/1995 | Nguyen et al. | 527/300 |
| 5,417,840 | A | 5/1995 | Block et al. | 205/246 |
| 5,435,898 | A | 7/1995 | Commander et al. | 205/245 |
| 5,462,983 | A | 10/1995 | Bloembergen et al. | 524/51 |
| 5,800,870 | A | 9/1998 | Luebke et al. | 427/369 |
| 5,883,762 | A | 3/1999 | Calhoun et al. | 360/113 |
| 6,040,379 | A | 3/2000 | Luebke et al. | 524/734 |
| 6,468,411 | B1 | 10/2002 | Eckles et al. | 205/246 |
| 6,602,394 | B1 | 8/2003 | Hillebrand | 205/246 |
| 6,652,728 | B1 | 11/2003 | Sonntag | 205/143 |

FOREIGN PATENT DOCUMENTS

| | | | | |
|---|---|---|---|---|
| GB | 1 602 404 | | | 11/1981 |
| GB | 2 104 920 | A | | 3/1983 |
| GB | 2104920 | A | * | 3/1983 |
| JP | 64-68488 | | | 3/1989 |
| JP | 64-68488 (01-068488) | | | 3/1989 |
| JP | 64068488 | A | * | 3/1989 |
| JP | 64068488 | A | * | 3/1989 |
| JP | 02025600 | A | * | 1/1990 |
| JP | 6-116780 | | | 4/1994 |
| JP | 06-116781 | | | 4/1994 |
| JP | 06116781 | A | * | 4/1994 |
| JP | 9-87885 | | | 3/1997 |
| JP | 10-60683 | | | 3/1998 |
| WO | 01/96631 | A1 | | 12/2001 |
| WO | 2005/073438 | A1 | | 11/2005 |

OTHER PUBLICATIONS

Hu et al.; "The Cracking and Decohesion of Thin Films on Ductile Substrates"; Acta Metal., 37, 3 (pp. 917-925) 1989. no month.

Ramanauskas et al.; "Corrosion Resistance and Microstructure of Electrodeposition Zn and Zn Alloy Coatings"; Surface and Coatings Technology 92 (1997) pp. 16-21. no month.

C.M. Vlad; "Texture and Corrosion Resistance of Metallic Coatings"; Institut für Metallkunde and Metallphysik, TU Clausthal, FRG; pp. 199-212. Date unknown.

Nash et al.; "The Ni-Zn (Nickel-Zinc System)"; Bulletin of Alloy Phase Diagrams; vol. 9, No. 5; 1987; pp. 422-430. no month.

Noumi et al.; "Newly Developed Ni-Zn Alloy Plated Steel Sheet "SZ" and Its Application to Automotive Uses"; Society of Automotive Engineers, Inc.; 1982. no month.

Gage et al.; "Corrosion Testing of Zinc and Zinc Alloy Electrodeposited Coatings"; Materials Research Laboratory, Defence Science and Technology Organization; Melborne, Australia; (pp. 65-1-65-15). Date unknown.

International Search Report and Written Opinion, Application No. PCT/US2004/043212, mailed Aug. 24, 2005.

* cited by examiner

ATOTP0109

ARTICLES WITH ELECTROPLATED ZINC-NICKEL TERNARY AND HIGHER ALLOYS, ELECTROPLATING BATHS, PROCESSES AND SYSTEMS FOR ELECTROPLATING SUCH ALLOYS

TECHNICAL FIELD

The present invention relates generally to baths, processes and systems for electroplating zinc-nickel ternary and higher alloys, and to articles comprising such alloys.

BACKGROUND OF THE INVENTION

For many years, attempts have been made and processes have been employed for electroplating a bright, level zinc-nickel alloy on a substrate such as a metal. Most of the processes employed commercially have employed acid baths, although some have employed alkaline baths. A great variety of additives have been used in attempts to enhance the brightness, levelness, ductility, strength and nickel content of the deposited zinc-nickel alloys.

Electrodeposited (ED) zinc-nickel alloys have found increasing use as corrosion resistant functional coatings. Variations of ED zinc-nickel alloys employing additional alloying elements have been proposed to help achieve specific niche application improvements such as the use of iron to improve paint receptivity, cobalt to improve corrosion resistance, cadmium to decrease hydrogen permeation. However, all the ED zinc-nickel alloys have difficulty with obtaining or retaining desirable mechanical properties. Many such ED zinc-nickel alloys exhibit undesirable characteristics such as cracking, flaking, chipping, brittleness, or low ductility. These undesirable characteristics are believed to be due to the fact that ED zinc-nickel alloys can, and usually do, include crystallographic phases that result in such undesirable characteristics. These crystallographic phases include, for example, the intermetallic ZnNi 'delta' phase at a nickel content of about 10 atomic percent (at %), the brass like "gamma" phase at a nickel content of about 12 at %, or the 'beta' phase at a nickel content of about 20 at %. Zinc-nickel alloys with all of these phases have been reported by various investigators. Even when the overall nickel content is outside the range normally required to form these phases, it has been reported that these problematic phases may be found in fresh ED zinc-nickel alloy or that they may form, over time, within a matrix of hexagonal zinc containing dissolved nickel.

A continuing and long-felt need has existed in the art for zinc-nickel alloys having enhanced brightness, levelness, ductility and strength, while avoiding the undesirable characteristics associated with previously attempted zinc-nickel alloys including additional alloying elements.

SUMMARY OF THE INVENTION

The present inventors have discovered that the introduction of relatively small amounts of tellurium and/or bismuth and/or antimony into an electrodeposited zinc-nickel alloy or into an electrodeposited ternary, quaternary or higher zinc-nickel alloy, e.g., $ZnNiM_1M_2 \ldots M_n$, will favorably affect the mechanical properties of the electrodeposited alloy. For example, the introduction of one or more of Te, Bi or Sb can increase the bendability of the electrodeposited alloy coating, can reduce the sometimes undesirable high initial nickel concentration at the beginning of electrodeposition, can vary the grain size of the electrodeposited alloy, and/or can increase the impact resistance of the electrodeposited alloy coating.

Additional benefits may be found and will become apparent to those of skill in the art from the present disclosure.

In one embodiment, the present invention relates to an electroplating bath for depositing a zinc-nickel ternary or higher alloy, including: a) zinc ions; b) nickel ions; and c) one or more ionic species selected from ions of $Te^{+4}$, $Bi^{+3}$ and $Sb^{+3}$, with the proviso that when the ionic species comprises $Te^{+4}$, the bath further comprises one or more additional ionic species selected from ions of $Bi^{+3}$, $Sb^{+3}$, $Ag^{+1}$, $Cd^{+2}$, $Co^{+2}$, $Cr^{+3}$, $Cu^{+2}$, $Fe^{+2}$, $In^{+3}$, $Mn^{+2}$, $Mo^{+6}$, $P^{+3}$, $Sn^{+2}$ and $W^{+6}$. In one embodiment, when the ionic species comprises one or more of $Bi^{+3}$ or $Sb^{+3}$, the bath further comprises one or more additional ionic species selected from ions of $Ag^{+1}$, $Cd^{+2}$, $Co^{+2}$, $Cr^{+3}$, $Cu^{+2}$, $Fe^{+2}$ $In^{+3}$, $Mn^{+2}$, $Mo^{+6}$, $P^{+3}$, $Sn^{+2}$ and $W^{+6}$.

In another embodiment, the present invention relates to a system for electroplating a substrate with a zinc-nickel ternary or higher alloy, including an electroplating apparatus including an electroplating cell for holding an electroplating bath, an anode, a cathode comprising the substrate to be electroplated, and a source of power operably connected to the anode and the cathode; and an electroplating bath including a) zinc ions; b) nickel ions; and c) one or more ionic species selected from ions of $Te^{+4}$, $Bi^{+3}$ and $Sb^{+3}$, with the proviso that when the ionic species comprises $Te^{+4}$, the electroplating bath further comprises one or more additional ionic species selected from ions of $Bi^{+3}$, $Sb^{+3}$, $Ag^{+1}$, $Cd^{+2}$, $Co^{+2}$, $Cr^{+3}$, $Cu^{+2}$, $Fe^{+2}$, $In^{+3}$, $Mn^{+2}$, $Mo^{+6}$, $P^{+3}$, $Sn^{+2}$ and $W^{+6}$. In one embodiment, when the ionic species comprises one or more of $Bi^{+3}$ or $Sb^{+3}$, the bath further comprises one or more additional ionic species selected from ions of $Ag^{+1}$, $Cd^{+2}$, $Co^{+2}$, $Cr^{+3}$, $Cu^{+2}$, $Fe^{+2}$, $In^{+3}$, $Mn^{+2}$, $Mo^{+6}$, $P^{+3}$, $Sn^{+2}$ and $W^{+6}$.

In another embodiment, the present invention relates to an electroplating bath for depositing a zinc-nickel ternary or higher alloy, including: a) zinc ions; b) nickel ions; and c) one or more ionic species selected from ions of $Te^{+4}$, $Bi^{+3}$ and $Sb^{+3}$, with the proviso that when the ionic species comprises $Te^{+4}$, the bath is free of a mixture of brighteners comprising both (i) reaction product of epihalohydrin with alkylene amines such as ethylenediamine or its methyl-substituted derivatives; propylenediamine or its methyl-substituted derivatives; diethylenetriamine or its methyl-substituted derivatives; and higher alkylene polyamines, and (ii) aromatic aldehydes.

In another embodiment, the present invention relates to a system for electroplating a substrate with a zinc-nickel ternary or higher alloy, including: an electroplating apparatus including an electroplating cell for holding an electroplating bath, the chamber having a divider separating the cell into a cathodic chamber and an anodic chamber by a divider, an anode in the anodic chamber, a cathode in the cathodic chamber, the cathode comprising the substrate to be electroplated, and a source of power operably connected to the anode and the cathode; and an electroplating bath in the cathodic chamber including: a) zinc ions; b) nickel ions; and c) one or more ionic species selected from ions of $Te^{+4}$, $Bi^{+3}$ and $Sb^{+3}$. In one embodiment, the bath further comprises one or more additional ionic species selected from ions of $Ag^{+1}$, $Cd^{+2}$, $Co^{+2}$, $Cr^{+3}$, $Cu^{+2}$, $Fe^{+2}$, $In^{+3}$, $Mn^{+2}$, $Mo^{+6}$, $P^{+3}$, $Sn^{+2}$ and $W^{+6}$.

In another embodiment, the present invention relates to an article comprising a zinc-nickel ternary or higher alloy, comprising zinc; nickel; and one or more element selected from Te, Bi, and Sb, with the proviso that when the alloy comprises Te, the alloy further comprises one or more additional element selected from Bi, Sb, Ag, Cd, Co, Cr, Cu, Fe, In, Mn, Mo, P, Sn and W. In one embodiment, the alloy is a higher alloy comprising one or more of Bi and Sb, and further comprises one or more additional element selected from Ag, Cd, Co, Cr, Cu, Fe, In, Mn, Mo, P, Sn and W.

In yet another embodiment, the present invention relates to an article comprising a zinc-nickel quaternary or higher alloy, comprising zinc; nickel; one or more element selected from Te, Bi and Sb; and one or more element selected from Ag, Cd, Co, Cr, Cu, Fe, In, Mn, Mo, P, Sn and W.

In still another embodiment, the present invention relates to a process for forming a zinc-nickel ternary or higher alloy, comprising immersing a substrate in one of the foregoing baths and carrying out an electroplating process with the bath to deposit on the substrate the ternary or higher alloy comprising one or more element corresponding to the one or more ionic species selected from $Te^{+4}$, $Bi^{+3}$ and $Sb^{+3}$ present in the bath, and in some embodiments, the ternary or higher alloy further comprises one or more additional elements corresponding to one or more ionic species selected from ions of $Ag^{+1}$, $Cd^{+2}$, $Co^{+2}$, $Cr^{+3}$, $Cu^{+2}$, $Fe^{+2}$, $In^{+3}$, $Mn^{+2}$, $Mo^{+6}$, $P^{+3}$, $Sn^{+2}$ and $W^{+6}$ present in the bath.

Articles made in accordance with the present invention display one or more desirable features, such as improved bendability, improved resistance to salt bath corrosion, reduced gray veil, lower initial nickel content, very small grain size, and resistance to hydrogen-induced embrittlement. Thus, in accordance with the present invention, a solution to one or more problems relating to zinc-nickel alloys known in the prior art can be provided.

Figure 1:
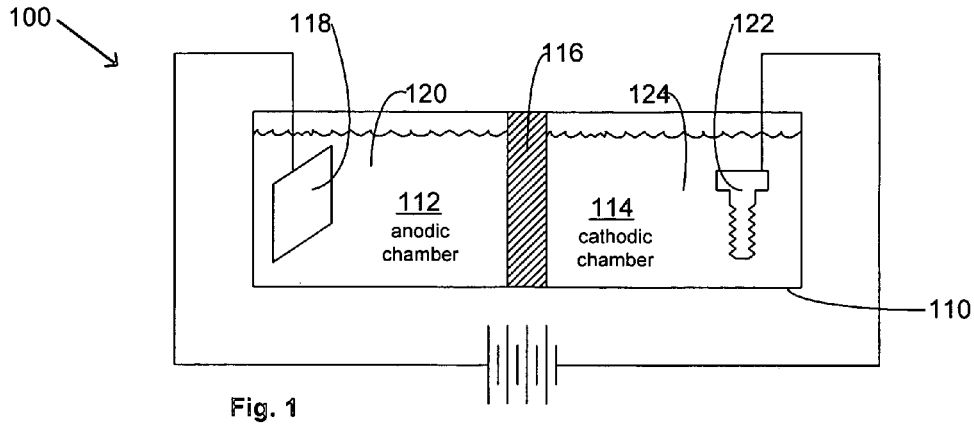
FIG. 1 is a schematic depiction of an electroplating cell in accordance with one embodiment of the present invention.

It should be appreciated that for simplicity and clarity of illustration, elements shown in the Figures have not necessarily been drawn to scale. For example, the dimensions of some of the elements may be exaggerated relative to each other for clarity. Further, where considered appropriate, reference numerals have been repeated among the Figures to indicate corresponding elements.

DETAILED DESCRIPTION

It should be appreciated that the process steps and structures described below do not form a complete process flow for manufacturing a device such as automotive parts or other plated articles incorporating the alloy of the present invention. The present invention can be practiced in conjunction with fabrication techniques currently used in the appropriate art, and only so much of the commonly practiced process steps are included as are necessary for an understanding of the present invention.

The improved zinc-nickel alloy electroplating baths of the present invention comprise an aqueous solution containing zinc ions, nickel ions and one or more additional metal ion. The alloy may have a general formula $ZnNiM_a$, or $ZnNiM_aM_b$, or $ZnNiM_aM_bM_c$, . . . $M_n$, etc., depending on the number n of additional atoms alloyed with the zinc and nickel. The additional atoms, alloyed with the zinc and nickel, may include one or more of Te, Bi, Sb, Ag, Cd, Co, Cr, Cu, Fe, In, Mn, Mo, P, Sn and W. The electroplating baths are free of added cyanide.

The terms "electroplating", "electrodeposition", or similar or cognate terms, refer to a process including passing an electrical current from an anode through a conductive medium containing, e.g., zinc ions, nickel ions and ions of one or more of Te, Sb and Bi, and in some embodiments, other ions as well, while the conductive medium is in contact with an electrically conductive substrate, e.g., the metal surface, in which the substrate functions as the cathode. Such terms are intended to incorporate their usual and customary meaning in the art, and include the use of complex waveforms of applied current, referred to in the art as, e.g., pulsed electroplating.

Zinc Ion

The electroplating baths of the present invention contain zinc ion. In one embodiment, the zinc ion is present at concentrations ranging from about 0.1 to about 100 g/l. In one embodiment, the concentration of zinc ion ranges from about 1 to about 50 g/l, and in another embodiment, from about 5 to about 20 g/l. The zinc ion may be present in the bath in the form of a soluble salt such as zinc oxide, zinc sulfate, zinc carbonate, zinc acetate, zinc sulfate, zinc sulfamate, zinc hydroxide, zinc tartrate, etc. In one embodiment, the zinc ion is obtained from one or more of ZnO, $Zn(OH)_2$, $ZnCl_2$, $ZnSO_4$, $ZnCO_3$, $Zn(SO_3NH_2)_2$, $Zn(OOCCH_3)_2$, $Zn(BF_4)_2$ and zinc methane sulfonate.

Nickel Ion

The electroplating baths of the present invention further comprise nickel ions. In one embodiment, the nickel ions are present at a concentration in the range from about 0.1 to about 50 g/l of nickel ions, and in one embodiment, the bath contains from about 0.5 to about 20 g/l of nickel ions. Sources of nickel ions which can be used in the electroplating baths include sources of nickel such as one or more of nickel hydroxide, inorganic salts of nickel, and organic acid salts of nickel. In one embodiment, the nickel source includes one or more of nickel hydroxide, nickel sulfate, nickel carbonate, ammonium nickel sulfate, nickel sulfamate, nickel acetate, nickel formate, nickel bromide, nickel chloride, etc. The nickel and zinc sources which may be used in the electroplating baths of the invention may comprise one or more of the above-described zinc sources and one or more of the above-described nickel sources. In one embodiment, the nickel ion is obtained from one or more of $NiSO_4$, $NiSO_4.6H_2O$, $NiCO_3$, $Ni(SO_3NH_2)_2$, $Ni(OOCCH_3)_2$, $(NH_2)_2Ni(SO_4)_2.6H_2O$, $Ni(OOCH)_2$, a Ni complex, $Ni(BF_4)_2$ and nickel methane sulfonate.

In one embodiment, the zinc ion and the nickel ion are present at concentrations sufficient to deposit a zinc-nickel ternary or higher alloy comprising a nickel content from about 3 wt % to about 25 wt % of the alloy. In another embodiment, the zinc ion and the nickel ion are present at concentrations sufficient to deposit a zinc-nickel ternary or higher alloy comprising a nickel content from about 8 wt % to about 22 wt % of the alloy. In another embodiment, the zinc ion and the nickel ion are present at concentrations sufficient to deposit a zinc-nickel ternary or higher alloy having a substantially gamma crystallographic phase. In another embodiment, the zinc ion and nickel ion are present at concentrations sufficient to deposit a zinc-nickel ternary or higher alloy comprising a gamma crystallographic phase. As is known in the art, a zinc-nickel ternary or higher alloy having a substantially gamma crystallographic phase is more resistant to corrosion, particularly chloride- or salt-derived corrosion, than is an alloy having a phase other than the substantially gamma phase.

Additional Elements Alloyed with Zinc and Nickel

As noted above, in addition to zinc and nickel, the electroplating bath in accordance with the present invention further includes one or more of $Te^{+4}$, $Bi^{+3}$ and $Sb^{+3}$ ions, and in some embodiments may also include one or more additional ionic species selected from ions of $Ag^{+1}$, $Cd^{+2}$, $Co^{+2}$, $Cr^{+3}$, $Cu^{+2}$, $Fe^{+2}$, $In^{+3}$, $Mn^{+2}$, $Mo^{+6}$, $P^{+3}$, $Sn^{+2}$ and $W^{+6}$. When the electroplating bath is used in the electroplating system described herein, and the process of electroplating is carried out, a new group of zinc-nickel alloys can be deposited on a conductive surface.

Thus, as a result of the present invention, a zinc-nickel ternary or higher alloy can be formed, comprising, in addition to zinc and nickel, one or more additional elements selected from Te, Bi, Sb, Ag, Cd, Co, Cr, Cu, Fe, In, Mn, Mo, P, Sn and W. Other elements may be included as well, but these are the elements of primary interest.

Some of the additional elements exist as polyvalent ions or as oxyanions (e.g., $H_2PO_2^-$, $MoO_4^{-2}$, $TeO_3^{-2}$ and $W_4^{-2}$). In one embodiment, the polyvalent ions are provided to the electroplating bath in their lower oxidation state. It has been found that such ions in the lower oxidation state are much easier to electroplate on a given substrate. In some embodiments, the higher oxidation states of these elements cannot be electroplated under ordinary conditions, while in other cases, it may be possible to electroplate the elements from their higher oxidation state, but it is not economically and/or technically feasible to do so. In one embodiment, since the additional element will be used in an aqueous electroplating bath, the material may be provided in a hydrated form; it is not necessary that it be in an anhydrous form. In some embodiments, the polyvalent ion, e.g., $Cu^{+2}$ is used at its higher oxidation state, or in an intermediate oxidation state, e.g., $Cr^{+3}$. As will be recognized, some of the elements are not polyvalent, e.g., $Ag^{+1}$, $Cd^{+2}$, $In^{+3}$ and $Zn^{+2}$, and so are used in their only non-zero oxidation state.

In one embodiment, the additional element in the alloy comprises one or more of Te, Bi and Sb. The present inventors have discovered that the introduction of small amounts of tellurium (Te) and/or bismuth (Bi) and/or antimony (Sb) into the zinc-nickel or a ternary, quaternary, or higher alloy, $ZnNiM_1M_2 \ldots M_n$ ($ZnNiM_n$) deposit can provide favorable effects on, e.g., the mechanical properties of the ternary or higher alloy deposit thus formed. For example, introduction of one or more of Te, Bi and Sb may increase the bendability of the coating and/or reduce the high initial nickel concentration at the beginning of electrodeposition and/or vary the grain size of the alloy and/or increase the impact resistance of the coating. All of these may be desirable features in particular uses of a zinc-nickel alloy.

In one embodiment, the Te is present at a concentration in the alloy greater than about 15-20 ppm. In another embodiment, the Te is present in the alloy at a concentration in the range from about 15-20 ppm to about 1 atomic percent (at %)(~1000 ppm), and in one embodiment, from about 15-20 ppm to about 0.1 at %. Te may be detected in the alloy by Proton Induced X-ray Emission (PIXE) in these concentration ranges.

The Te may be provided to the electroplating bath in the form of $Te^{+4}$, which may be obtained, for example, from one or more of $TeCl_4$, $TeBr_4$, $TeI_4$ or $TeO_2$. Although herein the Te ion is referred to generally as $Te^{+4}$, as will be understood by those of ordinary skill in the art, $Te^{+4}$ is more likely to exist in aqueous solution as the oxyanion $TeO_3^{-2}$. This oxyanion is believed to be more stable in aqueous solution than would be $Te^{+4}$. However, for convenience, the Te ion is referred to herein as $Te^{+4}$. In one embodiment, the $Te^{+4}$ is present in the electroplating bath at a concentration in the range from about 0.01 g/dm$^3$ to about 10 g/dm$^3$.

In one embodiment, the Bi is present at a concentration in the alloy greater than about 0.1 at %. In another embodiment, the Bi is present in the alloy at a concentration in the range from about 0.1 at % to about 5 at %, and in another embodiment, the Bi is present in the alloy at a concentration from about 0.5 at % to about 2 at %. Bi may be detected in the alloy by X-ray photoelectron spectroscopy (XPS) in these concentration ranges.

The Bi may be provided to the electroplating bath in the form of $Bi^{+3}$, which may be obtained, for example, from one or more of $Bi(CH_3CO_2)_3$, $BiF_3$, $BiCl_3$, $BiBr_3$, $BiI_3$, Bi salicylate, Bi gluconate, Bi citrate, $Bi(NO_3)_3$, $Bi_2O_3$ and $BiPO_4$. In one embodiment, the $Bi^{+3}$ is present in the electroplating bath at a concentration in the range from about 0.01 g/dm$^3$ to about 10 g/dm$^3$.

In one embodiment, the Sb is present at a concentration in the alloy greater than about 0.1 at %. In another embodiment, the Sb is present in the alloy at a concentration in the range from about 0.1 at % to about 5 at %, and in another embodiment, the Sb is present in the alloy at a concentration from about 0.5 at % to about 2 at %. Sb may be detected in the alloy by XPS in these concentration ranges.

The Sb may be provided to the electroplating bath in the form of $Sb^{+3}$, which may be obtained, for example, from one or more of $Sb(CH_3CO_2)_3$, $SbF_3$, $SbCl_3$, $SbBr_3$, $SbI_3$, potassium Sb tartrate ($C_4H_4KO_7Sb$), Sb citrate, $Sb(NO_3)_3$, $Sb_2O_3$ and $SbPO_4$. In one embodiment, the $Sb^{+3}$ may be present in the electroplating bath at a concentration in the range from about 0.01 g/dm$^3$ to about 10 g/dm$^3$.

In the foregoing, when two or more of the Te, Bi and Sb are present, their concentrations in the alloy are independently within the disclosed ranges. Similarly, when two or more of $Te^{+4}$, $Bi^{+3}$ and $Sb^{+3}$ ions are present in the electroplating bath, their concentrations are independently within the disclosed ranges.

In one embodiment, the additional element comprises one or more of Ag, Cd, Co, Cr, Cu, Fe, In, Mn, Mo, P, Sn and W. In one embodiment, each of the one or more of Ag, Cd, Co, Cr, Cu, Fe, In, Mn, Mo, P and W may be independently present at a concentration in the alloy greater than about 0.5 at %. In another embodiment, each of the one or more of Ag, Cd, Co, Cr, Cu, Fe, In, Mn, Mo, P, Sn and W may be independently present in the alloy at a concentration in the range from about 1 at % to about 30 at %, and in another embodiment, each of the one or more of Ag, Cd, Co, Cr, Cu, Fe, In, Mn, Mo, P, Sn and W may be independently present in the alloy at a concentration from about 2 at % to about 10 at %. Each of these elements may be detected in the alloy by Energy Dispersive Spectroscopy (EDS) in these concentration ranges.

The Ag may be provided to the electroplating bath in the form of $Ag^+$, which may be obtained, for example, from $AgNO_3$. In one embodiment, the $Ag^+$ is present in the electroplating bath at a concentration in the range from about 0.1 g/dm$^3$ to about 100 g/dm$^3$.

The Cd may be provided to the electroplating bath in the form of $Cd^{+2}$, which may be obtained, for example, from one or more of $CdCl_2$, $CdBr_2$, $Cd(NO_3)_2$ and $CdSO_4$. In one embodiment, the $Cd^{+2}$ is present in the electroplating bath at a concentration in the range from about 0.1 g/dm$^3$ to about 100 g/dm$^3$.

The Co may be provided to the electroplating bath in the form of $Co^{+2}$, which may be obtained, for example, from one or more of $Co(CH_3CO_2)_2$, $COCl_2$, $CoBr_2$, $CoCO_3$, $Co(NO_3)_2$, $CoSO_4$ and $CoPO_4$. In one embodiment, the $Co^{+2}$ is present in the electroplating bath at a concentration in the range from about 0.1 g/dm$^3$ to about 50 g/dm$^3$.

The Cr may be provided to the electroplating bath in the form of $Cr^{+3}$, which may be obtained, for example, from one or more of $CrCl_3$, $CrBr_3$, $Cr(NO_3)_3$ and $Cr_2(SO_4)_3$. In one embodiment, the $Cr^{+3}$ is present in the electroplating bath at a concentration in the range from about 1 g/dm$^3$ to about 100 g/dm$^3$.

The Cu may be provided to the electroplating bath in the form of $Cu^{+1}$, which may be obtained, for example, from one or more of $CuCl_2$, $CuBr_2$, $Cu(NO_3)_2$, Cu $SO_4$ and $Cu(H_2PO_2)_2$. In one embodiment, the $Cu^{+2}$ is present in the electroplating bath at a concentration in the range from about 1 g/dm$^3$ to about 100 g/dm$^3$.

The Fe may be provided to the electroplating bath in the form of $Fe^{+2}$ which may be obtained, for example, from $FeCl_2$. Although other sources of $Fe^{+2}$ may be used, the easiest to obtain is $FeCl_2$. In one embodiment, the $Fe^{+2}$ is present in the electroplating bath at a concentration in the range from about 0.1 g/dm$^3$ to about 50 g/dm$^3$.

The In may be provided to the electroplating bath in the form of $In^{+3}$, which may be obtained, for example, from one or more of $InCl_3$, $InBr_3$, $In(NO_3)_3$ and $In_2(SO_4)_3$. In one embodiment, the $In^{+3}$ is present in the electroplating bath at a concentration in the range from about 1 g/dm$^3$ to about 100 g/dm$^3$.

The Mn may be provided to the electroplating bath in the form of $Mn^{+2}$, which may be obtained, for example, from one or more of $Mn(CH_3CO_2)_2$, $MnCl_2$, $MnBr_2$, $MnCO_3$, $Mn(NO_3)_2$, $MnSO_4$ and $Mn(H_2PO_2)_2$. In one embodiment, the $Mn^{+2}$ is present in the electroplating bath at a concentration in the range from about 1 g/dm$^3$ to about 50 g/dm$^3$.

The Mo may be provided to the electroplating bath in the form of $Mo^{+6}$, which may be obtained, for example, from one or more of $MoCl_6$, $MoBr_6$, $Mo(NO_3)_6$, $MoO_3$ and $Mo(SO_4)_3$. Although herein the Mo ion is referred to generally as $Mo^{+6}$, as will be understood by those of ordinary skill in the art, $Mo^{+6}$ is more likely to exist in aqueous solution as the oxyanion $MoO_4^{-2}$. This oxyanion is believed to be more stable in aqueous solution than would be $Mo^{+6}$. However, for convenience, the Mo ion is referred to herein as $Mo^{+6}$. In one embodiment, the $Mo^{+6}$ is present in the electroplating bath at a concentration in the range from about 1 g/dm$^3$ to about 100 g/dm$^3$.

The P may be provided to the electroplating bath in the form of $P^{+3}$, which may be obtained, for example, from $H_3PO_2$, hypophosphorous acid, or a salt thereof. Although other sources of $P^{+2}$ may be used, the easiest to obtain is $H_3PO_2$. Although herein the P ion is referred to generally as $P^{+3}$, as will be understood by those of ordinary skill in the art, $P^{+3}$ is more likely to exist in aqueous solution as the oxyanion $H_2PO_2^{-2}$. This oxyanion is believed to be more stable in aqueous solution than would be $P^{+3}$. However, for convenience, the P ion is referred to herein as $P^{+3}$. In one embodiment, the $P^{+3}$ is present in the electroplating bath at a concentration in the range from about 0.1 g/dm$^3$ to about 100 g/dm$^3$.

The Sn may be provided to the electroplating bath in the form of $Sn^{+2}$, which may be obtained, for example, from one or more of $SnCl_2$, $SnBr_2$, $Sn(NO_3)_2$ and $SnSO_4$. In one embodiment, the $Sn^{+2}$ is present in the electroplating bath at a concentration in the range from about 0.1 g/dm$^3$ to about 100 g/dm$^3$.

The W may be provided to the electroplating bath in the form of $W^{+6}$, which may be obtained, for example, from one or more of $WO_3$, $WCl_6$ or $H_2WO_4$. Although herein the W ion is referred to generally as $W^{+6}$, as will be understood by those of ordinary skill in the art, $W^{+6}$ is more likely to exist in aqueous solution as the oxyanion $WO_4^{-2}$. This oxyanion is believed to be more stable in aqueous solution than would be $W^{+6}$. However, for convenience, the W ion is referred to herein as $W^{+6}$. In one embodiment, the $W^{+6}$ is present in the electroplating bath at a concentration in the range from about 0.1 g/dm$^3$ to about 100 g/dm$^3$.

When a combination of one or more of Te, Bi and Sb, or a combination of one or more of Te, Bi and Sb, together with one or more of Ag, Cd, Co, Cr, Cu, Fe, In, Mn, Mo, P, Sn and W is present in the zinc-nickel alloy, the concentration of each such alloying element may be independently selected.

In one embodiment, Te is present in the alloy together with one or more of Bi, Sb, Ag, Cd, Co, Cr, Cu, Fe, In, Mn, Mo, P, Sn and W. Thus, when Te is alloyed with zinc and nickel, in one embodiment, another of the elements is also present in the alloy, forming a quaternary or higher alloy.

In one embodiment, in which the electroplating chamber includes a divider forming a cathodic chamber and an anodic chamber, $Te^{+4}$ may be the lone additional metal ion present in the cathodic chamber of the cell, together with the zinc and nickel ions.

In one embodiment, the thickness of the zinc-nickel ternary or higher alloy ranges from about 100 nanometers to about 50 micrometers (μm), and in another embodiment from about 1 μm to about 25 μm, and in another embodiment, from about 3 μm to about 15 μm.

In the foregoing disclosure, as well as in the following disclosure and in the claims, the numerical limits of the disclosed ranges and ratios may be combined. Thus, for example, in the preceding thickness range, although not explicitly stated, the disclosure includes ranges from about 100 angstroms to about 10,000 angstroms and from about 10 angstroms to about 2500 angstroms.

In one embodiment, the electroplating bath is used to electrodeposit a ternary or higher zinc-nickel alloy on a conductive substrate to form an article having a layer of a ternary or higher zinc-nickel alloy, including zinc; nickel; and one or more element selected from Te, Bi, and Sb, with the proviso that when the alloy comprises Te, the alloy further comprises one or more additional element selected from Bi, Sb, Ag, Cd, Co, Cr, Cu, Fe, In, Mn, Mo, P, Sn and W. In one embodiment, when the layer of ternary or higher zinc-nickel alloy includes one or both of Bi and Sb, the alloy further comprises one or more additional element selected from Ag, Cd, Co, Cr, Cu, Fe, In, Mn, Mo, P, Sn and W.

In one embodiment, the electroplating bath is used to electrodeposit a zinc-nickel quaternary or higher alloy on a conductive substrate to form an article having a layer of a zinc-nickel quaternary or higher alloy, including zinc; nickel; one or more element selected from Te, Bi and Sb; and one or more element selected from Ag, Cd, Co, Cr, Cu, Fe, In, Mn, Mo, P, Sn and W.

Articles made in accordance with the present invention display one or more desirable features, such as improved bendability, improved resistance to salt bath corrosion, reduced gray veil, lower initial nickel content, very small grain size, and resistance to hydrogen-induced embrittlement.

Non-Ionogenic Surface Active Polyoxyalkylene Agent

As used herein, the term"non-ionogenic surface active polyoxyalkylene" refers to both (1) materials having a substantially non-ionic character, such as materials referred to in the chemical arts as nonionic surfactants, and (2) derivatives and reaction products of polyoxyalkylenes that have a limited degree of ionic character, but which are substantially non-ionic in character, such as a polyoxyalkylene with a terminal group such as, for example, a sulfonate, phosphonate, amine or halide group. Many such compounds are known in the art.

In one embodiment, the electroplating baths of the present invention include one or more non-ionogenic, surface active polyoxyalkylene compound present in an amount effective to provide grain refinement of a zinc-nickel ternary or higher alloy electroplated with the bath. Grain refinement means that the electrodeposited material has reduced roughness and/or reduced dendritic character, and more uniform coverage of the substrate on which the electrodeposited material is applied. A grain refining addition agent is one which improves the electrodeposition by reducing and, in one embodiment, eliminating, rough and dendritic deposits in areas in which the applied current density is relatively high, and by extending coverage of the electrodeposited material into areas in which the applied current density is relatively low. As is known in the art, when applying current in an electrodeposition process, distance or length of the cathodic substrate from the anode (current source) is inversely related to applied current density, so that parts of a cathodic substrate closer to the anode are exposed to a relatively higher current density and parts of a cathodic substrate further away from the anode are exposed to a relatively lower current density. In the absence of a grain refining agent, parts of a cathodic substrate exposed to a high current density may have a rough and/or dendritic electrodeposited material while, on the other hand, parts of the cathodic substrate exposed to low current density may be poorly covered by the electrodeposited material. The grain refining addition agent of the present invention may smooth and balance the process so that the electrodeposited material is smoother, more evenly distributed, and/or is free of dendritic deposits.

Acidic Bath

In one embodiment, the electroplating baths of the invention contain an acidic component in sufficient quantity to provide the bath with an acidic pH. In one embodiment, the acidic electroplating bath has a pH in the range from about 0.5 to about 6.5. In another embodiment, the acidic electroplating bath has a pH in the range from about 1 to about 6, and in another from about 1 to about 5, and in yet another, from about 1 to about 3. In one embodiment, the pH of the acidic bath is in the range from about 3.5 to about 5. In another embodiment, the acidic pH includes any pH up to, but less than 7.

The acidic electroplating bath may include any appropriate acid, organic or inorganic or appropriate salt thereof. In one embodiment, the acidic electroplating bath comprises one or more of hydrochloric acid, sulfuric acid, sulfurous acid, nitric acid, phosphoric acid, phosphorous acid, hypophosphorous acid, an aromatic sulfonic acid such as substituted or unsubstituted benzene sulfonic acids, toluene sulfonic acids, and similar and related aromatic sulfonic acids, methane sulfonic acids and similar alkyl sulfonic acids, a poly carboxylic acid such as citric acid, sulfamic acid, fluoboric acid or any other acid capable of providing a suitable acidic pH. The acid itself or an appropriate salt thereof may be used, as needed, e.g., to obtain the desired pH and ionic strength.

In one embodiment, an amount from about 5 to about 220 grams of salt and/or corresponding acidic component per liter of electroplating bath are utilized to obtain a pH in the acidic range, and in another embodiment, the amount is from about 10 to about 100 grams per liter. In one embodiment, the amount of acid is that sufficient to obtain the desired pH, as will be understood by those in the art.

Alkaline Bath

In one embodiment, the electroplating baths of the invention contain an inorganic alkaline component in sufficient quantity to provide the bath with an alkaline pH. In one embodiment, the amount of the alkaline component contained in the electroplating bath is an amount sufficient to provide a pH of at least 10, and in one embodiment, an amount sufficient to provide a pH of at least 11 or, in one embodiment, a pH of about 14. In one embodiment, the alkaline pH is in the range from a pH of about 7.5 to a pH of about 14.

The alkaline electroplating bath may contain any appropriate base. In one embodiment, the alkaline component is an alkali metal derivative such as sodium or potassium hydroxide, sodium or potassium carbonate, and sodium or potassium bicarbonate, etc., and mixtures thereof.

In one embodiment, an amount from about 50 to about 220 grams of alkaline component per liter of electroplating bath are utilized, and in another embodiment, the amount is from about 90 to about 110 grams per liter.

Those of ordinary skill in the art can appropriately determine and select the pH, acids, bases, buffers and concentrations thereof as needed for the particular combination of ionic species to be electrodeposited by baths, systems and processes in accordance with the present invention.

Complexing Agent

In one embodiment, the electroplating bath of the invention further comprises one or more complexing agent. In an embodiment in which the electroplating bath has an alkaline pH, it is useful to include a complexing agent to help dissolve and maintain in solution the nickel ion. In an acidic electroplating bath, nickel does not need a complexing agent to remain in solution. It is noted that some of the complexing agents are also listed above as acids useable in the acidic baths.

In an embodiment including one or more complexing agent, the one or more complexing agent may be any complexing agent known in the art. In one embodiment, the one or more complexing agent is a complexing agent suitable for nickel ion. In one embodiment, the one or more complexing agent may be one or more of the complexing agents described below. In another embodiment, the one or more complexing agent may be an amine such as ethylene diamine, diethylene triamine, and/or higher polyamines such as those described below.

In one embodiment, the one or more complexing agent comprises one or more polymer of an aliphatic amine. In one embodiment, the amount of the polymer of an aliphatic amine contained in the electroplating baths of the present invention ranges from about 1 to about 150 g/l and in another embodiment, ranges from about 5 to about 50 g/l.

Typical aliphatic amines which may be used to form such polymers of aliphatic amines include 1,2-alkyleneimines, monoethanolamine, diethanolamine, triethanolamine, ethylenediamine, diethylenetriamine, imino-bis-propylamine, polyethyleneimine, triethylenetetramine, tetraethylenepentamine, hexamethylenediamine, etc.

In one embodiment, polymers derived from 1,2-alkyleneimines are used, in which the alkyleneimines may be represented by the general formula (IV):

(IV)

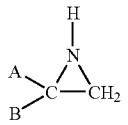

wherein A and B are each independently hydrogen or alkyl groups containing from 1 to about 3 carbon atoms. Where A and B are hydrogen, the compound is ethyleneimine. Compounds wherein either or both A and B are alkyl groups are referred to herein generically as alkyleneimines although such compounds have been referred to also as ethyleneimine derivatives.

Examples of poly(alkyleneimines) which are useful as a complexing agent in the present invention include polymers obtained from ethyleneimine, 1,2-propyleneimine, 1,2-butyleneimine and 1,1-dimethylethyleneimine. The poly(alkyleneimines) useful in the present invention may have molecular weights of from about 100 to about 100,000 or more although the higher molecular weight polymers are not generally as useful since they have a tendency to be insoluble in the electroplating baths of the invention. In one embodiment, the molecular weight will be within the range of from about 100 to about 60,000 and in another embodiment, from about 150 to about 2000. In one embodiment, the poly(ethyleneimine)s have molecular weights of from about 150 to about 2000. Useful polyethyleneimines are available commercially from, for example, BASF under the designations Lugalvan® G-15 (molecular weight 150), Lugalvan® G-20 (molecular weight 200) and Lugalvan® G-35 (molecular weight 1400).

The poly(alkyleneimines) may be used per se or may be reacted with a cyclic carbonate consisting of carbon, hydrogen and oxygen atoms. A description of the preparation of examples of such reaction products is found in U.S. Pat. Nos. 2,824,857 and 4,162,947, which disclosures are incorporated herein by reference. The cyclic carbonates further are defined as containing ring oxygen atoms adjacent to the carbonyl grouping which are each bonded to a ring carbon atom, and the ring containing said oxygen and carbon atoms has only 3 carbon atoms and no carbon-to-carbon unsaturation.

In one embodiment, the one or more complexing agent which can be incorporated into the electroplating baths of the present invention include carboxylic acids (or corresponding salts) such as citric acid, tartaric acid, gluconic acid, alpha-hydroxybutyric acid, sodium and/or potassium salts of said carboxylic acids; polyamines such as ethylenediamine, triethylenetetramine; amino alcohols such as N-(2-aminoethyl) ethanolamine, 2-hydroxyethylaminopropylamine, N-(2-hydroxyethyl)ethylenediamine, etc. When included in the baths of the invention, the amount of metal complexing agent may range from 5 to about 100 g/l, and more often the amount will be in the range of from about 10 to about 30 g/l.

In one embodiment, the one or more complexing agent useful in the electroplating baths of the present invention comprise compounds represented by the formula:

$$R^7(R^8)N—R^{11}—N(R^9)R^{10} \quad (V)$$

wherein $R^7$, $R^8$, $R^9$ and $R^{10}$ are each independently alkyl or hydroxyalkyl groups provided that one or more of $R^7$-$R^{10}$ is a hydroxy alkyl group, and $R^8$ is a hydrocarbylene group containing up to about 10 carbon atoms. In one embodiment, the groups $R^7$-$R^{10}$ may be alkyl groups containing from 1 to 10 carbon atoms, in one embodiment, the groups $R^7$-$R^{10}$ may be alkyl groups containing from 1 to 5 carbon atoms, or in another embodiment, these groups may be hydroxyalkyl groups containing from 1 to 10 carbon atoms, and in another embodiment, from 1 to about 5 carbon atoms. The hydroxyalkyl groups may contain one or more hydroxyl groups, and in one embodiment, one or more of the hydroxyl groups present in the hydroxyalkyl groups is a terminal group. In one embodiment, each of $R^7$, $R^8$, $R^9$ and $R^{10}$ is a hydroxyalkyl group as defined above.

Specific examples of complexing agents characterized by Formula (V) include N-(2-hydroxyethyl)-N,N',N'-triethylethylenediamine; N,N'-di(2-hydroxyethyl)N,N'-diethyl ethylenediamine; N,N-di(2-hydroxyethyl)-N',N'-diethyl ethylenediamine; N,N,N',N'-tetrakis(2-hydroxyethyl) ethylenediamine; N,N,N',N'-tetrakis(2-hydroxyethyl) propylenediamine; N,N,N',N'-tetrakis(2,3-dihydroxypropyl) ethylenediamine; N,N,N',N'-tetrakis(2,3-dihydroxypropyl) propylenediamine; N,N,N',N'-tetrakis(2-hydroxypropyl) ethylenediamine; N,N,N',N'-tetrakis(2-hydroxyethyl)1,4-diaminobutane; etc. An example of a useful commercially available metal complexing agent is Quadrol® from BASF. Quadrol is N,N,N',N'-tetrakis(2-hydroxypropyl)ethylenediamine.

Auxiliary Brightening Agents

In one embodiment, an auxiliary brightening agent is added to the electroplating bath. Many brightening agents are known in the art and may be suitably selected by those of ordinary skill in the art.

In one embodiment, one or more of the following auxiliary brightening agents may be added: the condensation product of piperazine, guanidine, formalin, and epichlorohydrin, as defined in U.S. Pat. No. 4,188,271 (described in more detail below, and incorporated by reference herein); polyethylene imine; pyridinium propyl sulfonate; N-benzyl-3-carboxy pyridinium chloride; trigonelline; Golpanol® PS (sodium propargyl sulphonate); propargyl alcohol; ethyleneglycol-propargylalcohol ether; BEO (ethoxylated butyne diol); Aerosol AY65 (sodium diamylsulfosuccinate); N,N'-bis[3-(dimethylamino)propyl]urea, polymer with 1,3-dichloropropane—see U.S. Pat. No. 6,652,726 B1; carboxyethylisothiuronium betaine; Rewopol® EHS (ethyl hexyl sulfate); benzothiazole; Lutensit® A-PS (a proprietary anionic surfactant from BASF); Lugalvan® BPC 34 (a 34 wt % aqueous solution of N-benzyl nicotinate); benzyl-2-methylimidiazole; Tamol® NN (a formaldehyde condensate of 2-naphthalene sulfonate); methyl naphthyl ketone; benzalacetone; Lutensit® CS40 (40% cumene sulfonate); Golpanol® VS (sodium vinyl sulfonate); benzothiazolium-2-[4-(dimethylamino)phenyl]-3,6-dimethyl chloride; DPS(N,N-dimethyldithiocarbamyl propyl sulfonic acid sodium salt); MPS (3-mercapto-1-proanesulfonic acid, sodium salt); OPS(O-ethyldithiocarbonato-S-(3-sulfopropyl)-ester, potassium salt); SPS (bis-(3-sulfopropyl)-disulfide, disodium salt); UPS (3-S-iosthiouronium propyl sulfonate); ZPS (3-(benzothiazolyl-2-mercapto)-propyl-sulfonic acid, sodium salt) (DPS, MPS, OPS, SPS, UPS and ZPS are available from Raschig GmbH); N-(polyacrylamide); safranin; crystal violet and derivatives thereof; phenazonium dyes and derivatives thereof; Lugalvan® HT (thiodiglycol ethoxylate); sodium citrate; sodium lauryl sulfate; Dequest® (1-hydroxyethylen-1,1-diphosphonic acid); Lugalvan® BNO (ethoxylated beta naphthol); Lugalvan® NES (sodium salt of a sulphonated alkylphenol ethoxylate); sulfurized benzene sulfonic acid; butynediol dihydroxypropyl sulfonate; sodium saccharin; MPSA (3-mercapto-1-propanesulfonic acid, sodium salt); the formaldehyde condensate of 1-naphthalene sulfonic acid;

benzotriazole; tartaric acid; EDTA (ethylenediamine tetraacetic acid); sodium benzoate; the aqueous reaction product of 2-aminopyridine with epichlorohydrin; Mirapol® A15 (ureylene quaternary ammonium polymer); the aqueous reaction product of imidazole and epichlorohydrin; vanillin; anisaldehyde; Heliotropin (piperonal); thiourea; polyvinyl alcohol; reduced polyvinyl alcohol; o-chlorobenzaldehyde; α-napthaldehyde; condensed naphthalene sulfonate; niacin; pyridine; 3-hydroxypropane sulfonate; allyl pyridinium chloride; dibenzenesulfonamide; pyridinium butane sulfonate; sodium allyl sulfonate; sodium vinyl sulfonate; naphthalene trisulfonic acid; cumene sulfonate; CMP (carboxymethylpyridinium chloride); Golpanol® 9531 (propargyl hydroxypropyl ether sulfonate); o-sulfobenzaldehyde; Lugalvan® ES-9571 (aqueous reaction product of imidazole and epichlorohydrin); mercapto thio ether; PVP (polyvinylpyrrolidone); sodium adipate; chloral hydrate; sodium gluconate; sodium salicylate; manganese sulfate; cadmium sulfate; sodium tellurite; and glycine. The foregoing list is not exhaustive and is exemplary only. Any other known brightener useful in electroplating zinc and/or nickel may be useful herein.

In one embodiment, the auxiliary brightener is a material disclosed and claimed in U.S. Pat. No. 6,652,728 B1, the disclosure of which is incorporated by reference herein for its teachings relating to the polymer of general formula A:

A

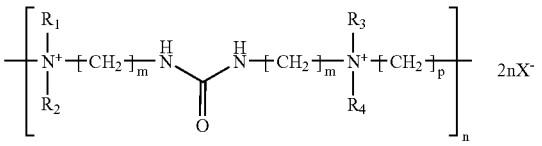

and the use thereof in zinc or zinc alloy electroplating baths. U.S. Pat. No. 6,652,728 B1 discloses an aqueous alkaline cyanide-free bath for the galvanic deposition of zinc or zinc alloy coatings on substrate surfaces, which is characterized in that the bath contains:

(a) a source of zinc ions and optionally a source of further metal ions, (b) hydroxide ions, and (c) a polymer soluble in the bath and having the general formula A:

wherein m has the value 2 or 3, n has a value of at least 2, $R_1$, $R_2$, $R_3$ and $R_4$, which may be the same or different, each independently denote methyl, ethyl or hydroxyethyl, p has a value in the range from 3 to 12, and $X^-$ denotes $Cl^-$, $Br^-$ and/or $I^-$. In one embodiment, in the above formula A, each of $R_1$, $R_2$, $R_3$ and $R_4$ are methyl, both m and p=3, $X^-$ is $Cl^-$ and n is in the range from 2 to about 80. The amount of this additive may range, in one embodiment, from about 0.1 g/l to about 50 g/l, and in one embodiment, from about 0.25 to about 10 g/l.

In one embodiment, in addition to any of the above brighteners, and in one embodiment, in addition to the material defined in U.S. Pat. No. 6,652,728 B1, there is also included in the bath a further additive which as a quaternary derivative of a pyridine-3-carboxylic acid of the formula B and/or a quaternary derivative of a pyridine-3-carboxylic acid of the formula C:

B

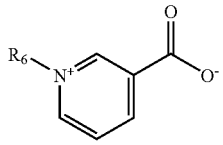

C

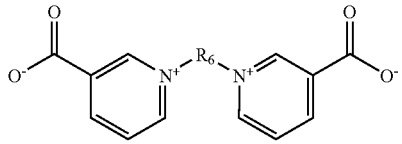

wherein $R_6$ denotes a saturated or unsaturated, aliphatic, aromatic or arylaliphatic hydrocarbon radical with 1 to 12 carbon atoms. The amount of this additional additive may range from about 0.005 to about 0.5 g/l, and in one embodiment, from about 0.01 to about 0.2 g/l.

The quaternary derivatives of a pyridine-3-carboxylic acid of the formula B or C that may be used in one embodiment as a further additive in the bath according to the invention are compounds known and described, for example, in DE 40 38 721. Similar materials are also disclosed in U.S. Pat. No. 3,296,105. These derivatives are generally prepared by reacting nicotinic acid with aliphatic, aromatic or arylaliphatic halogenated hydrocarbons.

In one embodiment, the electroplating bath may include one or more aldehyde as a brightener and/or to further improve gloss and leveling. Examples of aldehydes which may be included in the electroplating baths include one or more aromatic aldehydes such as anisaldehyde, 4-hydroxy-3-methoxybenzaldehyde (vanillin), 1,3-benzodioxole-5-carboxyaldehyde (piperonal), veratraldehyde, p-tolualdehyde, benzaldehyde, o-chlorobenzaldehyde, 2,3-dimethoxybenzaldehyde, salicylaldehyde, cinnamaldehyde, adducts of cinnamaldehyde with sodium sulfite, etc. The amount of aldehyde which may be included in the electroplating baths may range from about 0.01 to about 2 g/l.

The foregoing lists of brighteners are exemplary and are not intended to be either exhaustive or limiting of the scope of auxiliary brighteners which may be useful together with the present invention. Additional or alternative brighteners may be suitably selected by those of ordinary skill in the art.

In one embodiment, when $Te^{+4}$ is the only additional metal ion in the electroplating bath with the zinc ions and nickel ions, the bath is free of a mixture of brighteners comprising both (i) reaction product of epihalohydrin with amines such as ethylenediamine or its methyl-substituted derivatives, propylenediamine or its methyl-substituted derivatives, diethylenetriamine or its methyl-substituted derivatives, and (ii) aromatic aldehydes. In one embodiment, any single or other combination of brighteners may be used with $Te^{+4}$ or with any of the other additional elements used to form the zinc-nickel ternary or higher alloy.

Additional Bath Components

In one embodiment, the electroplating baths of the present invention include one or more additional components to provide further improved and stable electroplating baths and to provide for further improved zinc-nickel ternary or higher alloys. For example, electroplating baths may contain additional metal-complexing agents, aromatic aldehydes to improve the gloss or brightness of the alloy, polymers of aliphatic amines, surface-active agents, etc.

In one embodiment, the bath may further comprise an additive comprising a reaction product of one or more piperazines, one or more additional nitrogen-containing compound selected from the group consisting of ammonia or aliphatic acyclic compounds containing at least one primary amine group, formaldehyde, and an epihalohydrin or a glycerol halohydrin or mixtures thereof. Such reaction products are disclosed in U.S. Pat. No. 4,188,271, the disclosure of which relating to such reaction products is incorporated herein by reference. In one embodiment, the reaction product is obtained by the process of (a) preparing an intermediate product by reacting formaldehyde with a mixture of (i.) one or more piperazines having the formula (VI)

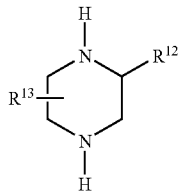

wherein $R^{12}$ and $R^{13}$ are each independently hydrogen or lower alkyl groups, and (ii.) one or more additional nitrogen-containing compound from the group consisting of ammonia or aliphatic, acyclic compounds containing at least one primary amine group, and (b) reacting said intermediate product with an epihalohydrin or glycerol halohydrin or mixtures thereof at a temperature within the range of from room temperature to the reflux temperature of the mixture. In one embodiment, the molar ratio of the piperazine(s), additional nitrogen-containing compound, formaldehyde and epihalohydrin or glycerol halohydrin is in the range of from about 1:1:2:1 to about 1:1:4.5:1.

In one embodiment, the additional nitrogen-containing compound is an aliphatic acyclic amine having at least two primary amine groups. In one embodiment, the epihalohydrin is epichlorohydrin. In one embodiment, the additional nitrogen-containing compound is ammonia, guanidine, one or more lower alkyl amines, one or more alkylene diamines or mixtures thereof. In one embodiment, the product is the condensation product of piperazine, guanidine, formalin, and epichlorohydrin, as defined in U.S. Pat. No. 4,188,271. When present this reaction product may be added to the bath in a concentration in the range from about 0.1 g/l to about 5 g/l, and in one embodiment at a concentration in the range from about 0.3 g/l to about 1 g/l, and in one embodiment, at a concentration of about 0.4 g/l.

In one embodiment, the electroplating bath according to the invention may further contain additives such as 3-mercapto-1,2,4-triazole and/or thiourea. The concentration of these additives is the normal concentration for use of such additives in zinc-nickel electroplating baths, and ranges for example from 0.01 to 0.50 g/l.

In one embodiment, the electroplating bath according to the invention may also contain a water softener. In one embodiment, the sensitivity of the bath to foreign metal ions, in particular calcium and magnesium ions from tap water, is reduced by the use of such additives. Examples of such water-softener are EDTA, sodium silicates and tartaric acid.

Processes

In one embodiment, the invention relates to a process for forming a zinc-nickel ternary or higher alloy, including immersing a substrate in the electroplating bath described herein and carrying out an electroplating process with the bath to deposit on the substrate the alloy comprising one or more element corresponding to the one or more ionic species. The process steps may include, for example, pre-cleaning parts on which the alloy is to be deposited, placing the parts in an appropriate apparatus, such as a plating barrel so that the parts will be in electrical contact with and/or will form a cathode, in an embodiment in which a divider is used, placing an appropriate anodic electrolyte in the anodic chamber, and applying a current to the anode so that the one or more ionic species in the cathodic chamber or in the electroplating bath is deposited together with zinc and nickel to form a ternary or higher electrodeposit on the surfaces of the parts. The process may also include steps such as checking concentrations of species consumed by the process, replenishing those species as needed to maintain the desired relative concentrations of zinc, nickel and each of the one or more ionic species co-deposited with the zinc and nickel to form the desired zinc-nickel ternary or higher alloy having the desired relative concentrations of zinc, nickel and alloying element(s). Those of ordinary skill in the art can appropriately select steps and conditions based on the desired alloy, the parts on which the alloy is to be electroplated, and other factors based on the present disclosure.

Conditions of pH, Temperature, Time, Current Density

The electroplating baths of the invention can be prepared by conventional methods, for example, by adding the specific amounts of the above-described components to water.

By use of the electroplating bath according to the invention, in one embodiment, electrically conducting substrates of metal may be provided with a bright, level, highly ductile and corrosion resistant coating of zinc-nickel ternary or higher alloy or other appropriate alloy.

The present invention accordingly relates to a process for the electroplating or electrodeposition of zinc-nickel ternary or higher alloy coatings on conventional substrates, which is characterized in that a bath having the above-described composition may be used as an electroplating bath. The electroplating baths of the present invention deposit a bright, level and ductile zinc-nickel ternary or higher alloy on substrates. In the process according to the invention, in one embodiment, the deposition of the coatings is carried out at a current density in the range from about 0.01 to about 150 A/dm$^2$, in one embodiment, from about 0.5 to about 25 A/dm$^2$ and in one embodiment, from about 1 to about 10 A/dm$^2$. The process conveniently may be carried out at room temperature, or at a lower or higher temperature. In one embodiment, the process may be carried out at a temperature, in one embodiment, in the range from about 10° C. to about 90° C., and in one embodiment, from about 15° C. to about 45° C., and in one embodiment, about 25° C. to about 40° C. The disclosed higher temperatures may be useful, e.g., for inducing evaporation of water from the electrolyte.

In one embodiment, the process according to the invention may be carried out as a barrel electroplating process when used for mass parts, and as a rack electrogalvanizing process for deposition on larger workpieces. In this connection anodes are used that may be soluble, such as for example zinc anodes, which at the same time serve as a source of zinc ions so that the zinc deposited on the cathode is recovered by dissolution of zinc at the anode. Alternatively insoluble anodes such as for example nickel or iron anodes may also be used, in which case the zinc ions removed from the electrolyte would have to be replenished in another way, for example by using a zinc dissolving tank. In one embodiment, when the anodes are iron anodes, or another such metal, the anode is isolated by a suitable membrane or other divider, from the cathode and the remainder of the bath.

As is usual in electrodeposition, the process according to the invention may also be operated with appropriate gas injection or eductors to provide agitation of the electrolyte and with or without movement of the articles being coated (e.g., cathode rod agitation or barrel rotation), without having any deleterious effects on the resultant coatings.

The electroplating baths of the invention may be operated on a continuous or intermittent basis and, from time to time, the components of the bath may have to be replenished. The various components may be added singularly as required or may be added in combination. The amounts of the various components to be added may be added on either a continuous basis or on an intermittent bases. The concentrations may be determined at appropriate intervals based on experience, or may be continuously determined, for example, by automated analytical instrumentation. The amounts of the various components to be added to the electroplating bath may be varied over a wide range depending on the nature and the performance of the electroplating baths to which the components is added. Such amounts can be determined readily by one of ordinary skill in the art.

The electroplating baths of the invention can be used over substantially all kinds of conductive substrates on which a zinc-nickel alloy can be deposited. Examples of useful substrates include those of mild steel, spring steel, chrome steel, chrome-molybdenum steel, copper, copper-zinc alloys, etc., including such substrates which have an initial electroplated strike or barrier layer applied thereto prior to application of the zinc-nickel ternary or higher alloy in accordance with the present invention. As is known, a strike layer is one which may make the substrate more receptive to subsequently applied layers, such as the present zinc-nickel ternary or higher alloy layer, and a barrier layer is one which hinders diffusion or migration of atoms between layers, such as between the substrate and the present zinc-nickel ternary or higher alloy layer. The strike layer may be, for example, an acidic zinc layer, an acidic zinc-nickel alloy layer or an acidic nickel layer, or other known strike layer material.

Thus, as described above, in one embodiment, the present invention relates to a process for electroplating a zinc-nickel ternary or higher alloy on a substrate, comprising electroplating the substrate with the electroplating bath described herein. The present invention further relates to an article comprising a substrate electroplated according to the process described herein.

Electroplating Bath Chamber Divider

The multivalent ions $Te^{+4}$, $Bi^{+3}$ and $Sb^{+3}$ are introduced into the plating solution in their lowest non-metallic or non-metalloid oxidation state and lose their electrodeposition efficacy at their higher oxidation states. Some of the additional ionic species, e.g., $Cr^{+3}$, $Fe^{+2}$ and $Mn^{+2}$, are used in lower oxidation states and are also subject to possible oxidation. These multivalent ions can be oxidized if present at or near the anode. To solve this problem, the present inventors have discovered that, in one embodiment, it is useful and helpful to separate the anode from the multivalent ions. In one embodiment, the anodes are isolated from the bulk of the solution (the catholyte or cathodic medium) by a divider, such as an ionic membrane, a salt bridge, or other means.

In one embodiment, the electroplating system includes an electroplating cell or chamber including divider separating the cell or chamber into an anodic chamber and a cathodic chamber. The divider allows the use of different baths in the two chambers formed by the divider. In general, the metal surface to which the zinc-nickel ternary or higher alloy will be electroplated will be immersed in the cathodic chamber, and will act as the or as part of the cathode in the electroplating process. The anode is in the anodic chamber. In one embodiment, the compositions of the baths in the two chambers are different, as described in more detail below. This feature provides a number of benefits with respect to the present invention.

FIG. 1 is a schematic depiction of an apparatus 100 for electroplating a conductive substrate with a zinc-nickel ternary or higher alloy, in accordance with one embodiment of the present invention. The apparatus 100 includes an electroplating cell 110, having an anodic chamber 112 and a cathodic chamber 114. The anodic chamber 112 is separated from the cathodic chamber 114 by a divider 116. The divider 116 allows electrical current and, in some embodiments, allows selected ions to pass through the divider 116, but prevents the passage of other ions and molecules. In one embodiment, selection of the appropriate divider 116 allows selection and/or control of which ions traverse the divider.

As shown in FIG. 1, in the anodic chamber 112 there is disposed an anode 118, which is immersed in a conductive anodic medium 120. In accordance with one embodiment of the invention, the anode 118 may be formed of an active, inexpensive metal such as iron, etc. In accordance with this embodiment of the present invention, because the anodic chamber 112 is separated from the cathodic chamber 114, it is not necessary that the anode be coated with or be formed of an inert or relatively unreactive metal, as in the prior art.

As noted, use of the divider enables the use of less expensive, more active metals as the anode(s), while at the same time avoiding release of ions of the anode material into the cathodic medium and thence deposition thereof onto the metal surface. In one embodiment of the present invention, the anode metals may be prevented from depositing on the cathode metal surface. In another embodiment, such as when an ion-selective divider is used, a metal from the anode may be controllably allowed to deposit on the cathode metal surface.

In one embodiment, use of the divider 116 allows the system to be operated more efficiently because it avoids or substantially reduces oxidation of the elements used as the ternary or higher elements of the zinc-nickel ternary or higher alloy. As noted previously, in accordance with some embodiments of the present invention, many of these elements are present in the electroplating bath and are electrodeposited from their lower oxidation state. In some embodiments, these species do not electrodeposit well, and in some embodiments, do not electrodeposit at all, from their higher oxidation states. If these elements in their lower oxidation state undergo oxidation to higher oxidation states, they are effectively lost from the electroplating bath if they cannot be deposited in the alloy. Therefore, it is a substantial benefit to avoid oxidation of these species in the electroplating bath. As described below, in some embodiments, the electrodeposition apparatus includes both a cathodic chamber and an anodic chamber, and the electroplating bath of the present invention is in only the cathodic chamber, while a different conductive medium is present in the anodic chamber.

In one embodiment, the anode 118 may be in the form of a plate or any other suitable shape, as known in the art. As described below, in other embodiments, the anode may be conformal, either partially surrounding or conforming to a divider; the anode may be surrounded by a divider; or the anode may be substantially covered or coated by a divider. In one embodiment, more than one anode may be used, as needed. The anode shape and number may be suitably selected as needed based on factors such as the current density, the configuration of the electroplating cell, the chemistry of the electroplating bath or the conductive anodic medium in the anodic chamber, and other factors known to those of ordinary skill in the art.

The anodic chamber 112 contains a conductive anodic medium 120. The only limiting criteria for the anodic medium is that it be conductive of an electrical current. The conductive anodic medium 120 may be acidic, neutral or basic. In one embodiment, the conductive anodic medium 120 is acidic, i.e., has a pH lower than 7. In one embodiment, the anodic medium has a pH in a range from about 0.5 to about 6.5, and in one embodiment, the anodic medium has a pH in a range from about 2 to about 6, and in another embodiment, a pH in a range from about 3 to about 5. In one embodiment, the conductive anodic medium 120 has a basic pH, i.e., has a pH higher than 7. In one embodiment, the conductive anodic medium 120 has a pH of 9 or higher. In another embodiment, the conductive anodic medium 120 has a pH of 11 or higher. In one embodiment, the conductive anodic medium has a pH in the range from about 7.5 to about 14.

The conductive anodic medium 120 contains suitable acids, bases, salts and/or buffering agents to attain the selected pH. Persons of ordinary skill in the art can determine and select the appropriate combination of acids, bases, salts and/or buffering agents to attain the selected pH.

In one embodiment, the conductive anodic medium comprises an aqueous solution of an alkali or alkaline earth metal hydroxide. In one embodiment, the conductive anodic medium comprises an aqueous solution of sodium hydroxide or potassium hydroxide. In one embodiment, the conductive anodic medium comprises from about 1 wt % to about 50 wt % of an alkali or alkaline earth metal hydroxide. In another embodiment, the conductive anodic medium comprises from about 3 wt % to about 25 wt % of an alkali or alkaline earth metal hydroxide. In another embodiment, the conductive anodic medium comprises from about 5 wt % to about 15 wt % of an alkali or alkaline earth metal hydroxide. In another embodiment, the conductive anodic medium comprises from about 6 wt % to about 10 wt % of an alkali or alkaline earth metal hydroxide.

In one embodiment, the conductive anodic medium comprises an aqueous solution of one or more mineral acids. In one embodiment, the conductive anodic medium comprises an aqueous solution of, for example, hydrochloric acid, sulfuric acid, nitric acid, phosphoric acid, fluoboric acid, methane sulfonic acid, or sulfamic acid. In one embodiment, the conductive anodic medium comprises from about 1 wt % to about 50 wt % of a mineral acid. In another embodiment, the conductive anodic medium comprises from about 3 wt % to about 25 wt % of a mineral acid. In another embodiment, the conductive anodic medium comprises from about 5 wt % to about 15 wt % of a mineral acid. In another embodiment, the conductive anodic medium comprises from about 6 wt % to about 10 wt % of a mineral acid.

In one embodiment, the conductive anodic medium 120 in the anodic chamber 112 is free of oxidizable organic or inorganic additives. In one embodiment, the conductive anodic medium in the anodic chamber is free of oxidizable organic or inorganic compounds. "Free of oxidizable organic or inorganic compounds" means that the conductive anodic medium contains substantially no oxidizable organic or inorganic compounds, from any source other than impurities and other inadvertently present species. In one embodiment, the conductive anodic medium in the anodic chamber is free of oxidizable organic additives. "Free of organic additives" means that no organic additives are intentionally placed or included in the conductive anodic medium.

The conductive anodic medium may be prepared by simply dissolving the acid and/or base, buffering agents and any other ingredients in water, with appropriate temperature control as needed to facilitate dissolution.

As shown in FIG. 1, in the cathodic chamber 114 there is disposed an object 122, which is immersed in an electroplating bath 124. In accordance with an embodiment of the present invention, the object 122 includes a conductive metal surface. As noted above, the conductive metal surface acts as the cathode in the apparatus shown in FIG. 1. In accordance with an embodiment of the present invention, the electroplating bath 124 includes a mixture of ions including zinc ions, nickel ions and one or more ions of Te, Sb, Bi, Ag, Cd, Co, Cr, Cu, Fe, In, Mn, Mo, P, Sn and W, as described in more detail above. The object 122 is depicted in FIG. 1 in the form of a bolt or screw, but the invention is not limited to such an object or to any object in particular. As noted above, the object may be any object which includes a conductive metal surface.

Divider Materials

In one embodiment, the divider comprises one or more of a salt bridge, an ion-selective membrane, a sol-gel, an ion-selective anode coating, an anode-conforming ion-selective membrane and a porous ceramic such as used in a Daniel cell.

In one embodiment, membranes have been found to be useful as the divider. In various embodiments, the ion-selective membrane may be anionic, cationic, bipolar or charge-mosaic type membrane. The anionic membrane may also be referred to as an anion-exchange membrane, and the cationic membrane may also be referred to as a cationic-exchange membrane. A bipolar membrane is an ion-exchange membrane having a structure in which a cationic membrane and an anionic membrane are attached together. A charge-mosaic membrane is composed of a two-dimensional or three-dimensional alternating cation- and anion-exchange channels throughout the membrane. In one embodiment, a combination of an anionic and a cationic membrane is used, with the anionic-selective membrane on the anode side and the cationic-selective membrane on the cathode side. In another embodiment, a combination of an anionic and a cationic membrane is used, with the cationic-selective membrane on the anode side and the anionic-selective membrane on the cathode side. In such combinations of anionic and cationic, the membranes are separated at least slightly during use, in distinction to a bipolar membrane, in which the two membranes are attached together. In one embodiment, the bipolar ion-selective membrane is disposed with its cationic side toward the cathode and its anionic side towards the anode, and in another embodiment, in the opposite configuration. Any known anionic, cationic, bipolar or charge-mosaic membrane may be used, and appropriate membranes may be selected from those known in the art.

Exemplary ion-selective membranes can be made from materials such as NAFION®, perfluorosulfonate ionomers and polyperfluorosulfonic acid; ethylene-styrene interpolymer (ESI) available from Dow Chemical; sulfonated polyarylether ketone, such as VICTREX® PEEK™, polybenzimidazole, available as PBI® from Celanese GmbH.

In one embodiment, a microporous material may also be used as the divider. For example, in one embodiment, the porous ceramics such as those used in Daniel cells may be used as the divider in the present invention.

In one embodiment, the divider may be prepared by a method such as that disclosed in U.S. Pat. No. 5,590,383, or any of those disclosed in the background section of this patent. The disclosures of U.S. Pat. No. 5,590,383 relating to microporous membranes is incorporated herein by reference, including in particular the book by Ramesh Bhave, Inorganic Membranes (van Nostrand, 1991) and the article by Y. S. Lin and A. J. Burggraaf, J. Amer. Ceram. Soc., Vol. 4, 1991, p. 219.

In one embodiment, the divider may be a salt bridge or a sol-gel bridge. A salt bridge can provide the electrical connection between the anodic chamber and the cathodic chamber while keeping the two chambers separated. The salt bridge allows electrons and some ions to transfer between the two chambers. The salt bridge may contain, for example, NaCl, KCl, $KNO_3$, or other salts such as alkaline, alkaline earth and transition metal salts.

Figure 3:
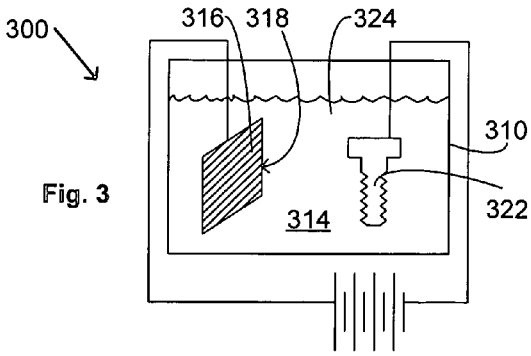
FIG. 3 is a schematic depiction of an electroplating cell in accordance with yet another embodiment of the present invention.

In other embodiments, the divider may be a coating on the anode which would avoid oxidation of species in the surrounding medium. An example of such is shown in FIG. 3. The coating may be, for example, one of the polymeric materials disclosed above for use as an ion-selective membrane, or may be a porous ceramic material.

Figure 5:
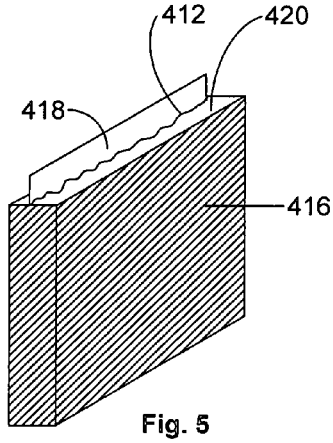
FIG. 5 is an enlarged view of a container formed by an embodiment of the divider.
Figure 4:
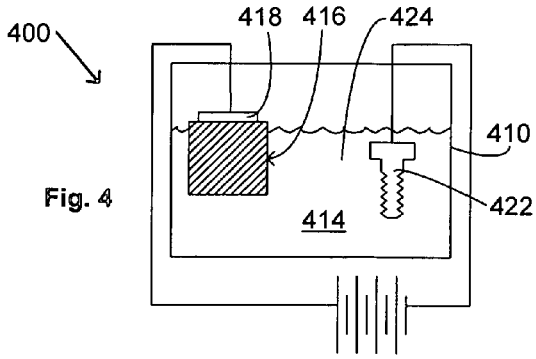
FIG. 4 is a schematic depiction of an electroplating cell in accordance with still another embodiment of the present invention.

In one embodiment, the divider may be any of those described above configured as a container disposed relatively close to, but not in contact with, the anode. An example of such is shown in FIGS. 4 and 5.

In one embodiment, when the electroplating system includes a divider and the system is operated with one or more ionic species present in the electroplating bath at a lower oxidation state (e.g., $Sb^{+3}$, $Bi^{+3}$ or $Te^{+4}$), substantially no oxidation to the higher oxidation state (e.g., $Sb^{+5}$, $Bi^{+5}$ or $Te^{+6}$) is observed after 10 amp-hours per liter of the electroplating bath in the cathodic chamber (A·Hr/l). In one embodiment, no such oxidation is observed after 20 A·Hr/l.

Of course, in some embodiments, a certain amount of such unwanted oxidation may occur even when a divider is used. That is, even though the divider is used, it may be only partly successful in avoiding such unwanted oxidation of the ionic species used with zinc and nickel for forming the zinc-nickel ternary or higher alloy. In one embodiment, when these ionic species are added to an electroplating bath without a divider, such oxidation is observed almost as soon as the electroplating is initiated, resulting in a loss of efficiency as the lower oxidation state ionic species are depleted from the bath by the oxidation instead of by deposition on the conductive substrate. As is known in the art, when a current is applied at the anode, electrons entering an aqueous solution from the anode hydrolyze water and generate oxygen gas at or near the anode. In the absence of the divider of the present invention, such oxygen causes oxidation of oxidizable organic and/or inorganic species present in the electroplating bath in which the anode is placed.

Of course, as will be recognized, some of the ionic species are univalent (e.g., $Ag^{+}$, $Cd^{+2}$, $In^{+3}$) and so are not subject to such unwanted oxidation, some (e.g., $Cu^{+2}$) may be used at their higher oxidation state in some embodiments of the present invention, while others (e.g., $Cr^{+3}$) are used in an intermediate oxidation state which is subject to such unwanted oxidation.

In one embodiment, the sol-gel bridge may include, for example, a silicate sol-gel with a conductive medium attached, adhered or bonded thereto, the conductive medium including, for example, graphite or a conductive polymer as noted below, such as polyaniline or polyvinylpyridine. In one embodiment, the divider comprises a sol-gel, and in another embodiment a sol-gel membrane. A sol-gel is a colloidal suspension of particles of silica, alumina or a combination of silicon-based material or alumina with organic compounds, that is gelled to form a solid. The resulting porous gel can be formed as a membrane and used directly as the divider or may be first chemically modified. In one embodiment, a sol-gel membrane which is an organic-inorganic hybrid, which has been referred to as a ceramer, may be employed as the divider. For example, TEOS (tetraethylorthosilicate) may be coupled with polymers such as poly(methyl) methacrylate, poly(vinyl acetate), poly (vinyl pyrrolidone), poly (N,N-dimethylamide), polyaniline, polyvinylpyridine and graphite, and these may be made into films or membranes suitable for use as the divider. Other known sol-gel materials may be used as well. Other conductive polymers which may possibly be used with the sol-gel membranes as a divider include, for example, 3,4-polyethylene dioxythiophene polystyrene sulphonate (PEDT/PSS); polyvinylpyrrolidone (PVP), poly (vinyl pyridine-co-vinyl acetate) (PVPy-VAc), polymethacrylic acid (PMAA), poly (hydroxyethylacrylate-co-methacrylic acid) (PHEA-MAA) and poly (2-hydroxyethyl methacrylate) (PHEMA); polyvinylbutyral (PVB). Other known conductive polymers may be used in conjunction with porous membranes as a divider in other embodiments.

Figure 2:
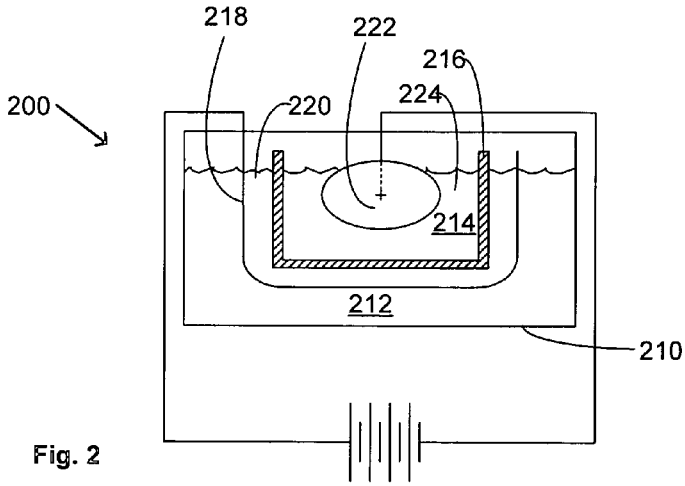
FIG. 2 is a schematic depiction of an electroplating cell in accordance with another embodiment of the present invention.

FIG. 2 is a schematic depiction of an apparatus 200 for electroplating a conductive substrate with a zinc-nickel ternary or higher alloy, in accordance with another embodiment of the present invention. The apparatus 200 includes an electroplating cell 210, having an anodic chamber 212 and a cathodic chamber 214. The anodic chamber 212 is separated from the cathodic chamber 214 by a divider 216. The divider 216 allows electrical current and, in some embodiments, allows selected ions to pass through the divider 216, but prevents the passage of other ions and molecules. The divider 216 may be formed of any of the divider materials disclosed above with regard to the first embodiment.

As shown in FIG. 2, in the anodic chamber 212 there is disposed an anode 218, which is immersed in a conductive anodic medium 220. The anode 218 in this embodiment is a conformal anode, in which the conformal anode 218 at least partially surrounds and/or conforms to the shape of the divider 216. Although shown as partially surrounding the divider 216, in one embodiment the conformal anode 218 may surround the divider 216, either as a band (i.e., covering the sides and having an open top and bottom) or as a partial enclosure (i.e., surrounding the sides and the bottom but with an open top). These alternate embodiments are not shown, but should be within the skill in the art.

The anodic chamber 212 contains a conductive anodic medium 220. The conductive anodic medium 220 may be acidic, neutral or basic and may have any of the pH values disclosed above with regard to the first embodiment. The conductive anodic medium 220 contains suitable acids, bases, salts and/or buffering agents to attain the selected pH. Persons of ordinary skill in the art can determine and select the appropriate combination of acids, bases, salts and/or buffering agents to attain the selected pH.

As described in above, in one embodiment, the conductive anodic medium 220 in the anodic chamber 212 is free of oxidizable organic additives.

As shown in FIG. 2, in the cathodic chamber 214 there is disposed a container 222, which is at least partially immersed in an electroplating bath 224 in accordance with one embodiment of the invention. The container 222 may be a barrel or other enclosure as is known in the electrodeposition arts for treating a plurality of relatively small parts, in which the container rotates, oscillates or otherwise moves to ensure uniform exposure of the parts to the electroplating bath. In one embodiment, the container 222 includes a non-conductive surface, but contains inside the barrel conductive metal parts for treatment in accordance with the present invention. As noted above, the conductive metal parts in the barrel 222 act as the or as part of the cathode in the apparatus shown in FIG. 2. The container 222 is depicted in FIG. 2 in the form of an oblong or elliptical shape, but this embodiment of the invention is not limited to such a shape or any shape container in particular. As noted above, the container may be any container which is capable of exposing the parts inside the container to the electroplating bath 224 in a way which results in the formation of a regular, even deposit on the surface of the parts. As in all embodiments of the present invention, the parts may comprise any kind of metal or conductive objects.

The electroplating bath 224, as noted, includes the ions included in the electroplating bath as described above, which is not repeated here for brevity.

The embodiment illustrated in FIG. 2 depicts both the conformal anode 218 and the barrel 222, used together with the divider 216 to which the conformal anode 218 conforms, but it is not so limited. In one embodiment, the barrel may be disposed in the cathodic chamber of an apparatus such as shown in FIG. 1. In another embodiment, a conformal anode is used surrounding a divider similar to the divider 216, but in which one or more objects such as the object 122 are suspended as the cathode(s).

In one embodiment, the electroplating bath 224 in the cathodic chamber 214 contains one or more organic or inorganic species which would oxidize if in the conductive anodic medium 220. In one embodiment, the organic or inorganic species is one of the foregoing additional ions (e.g., ions of Te, Bi, Sb, Ag, Cd, Co, Cr, Cu, Fe, In, Mn, Mo, P, Sn and W) in the electroplating bath 224.

FIG. 3 illustrates yet another embodiment of the present invention. FIG. 3 is a schematic depiction of an apparatus 300 for electroplating a conductive substrate with a zinc-nickel ternary or higher alloy, in accordance with another embodiment of the present invention. The apparatus 300 includes an electroplating cell 310, having a cathodic chamber 314, but no separate anodic chamber. The apparatus 300 includes an anode 318 and a divider 316. In this embodiment, the anode 318 is separated from the cathodic chamber 314 by the divider 316. In this embodiment, the divider surrounds, and in one embodiment, is applied to the surface of, the anode 318. The divider 316 allows electrical current and, in some embodiments, allows selected ions to pass through the divider 316, but prevents the passage of other ions and molecules. The divider 316 may be formed of any of the divider materials disclosed above with regard to the first embodiment.

As noted with respect to the first and second embodiments, in accordance with one embodiment of the invention, the anode 318 may be formed of any of the materials disclosed above for the anodes.

Other elements of the electroplating cell 310 of this embodiment are substantially the same as described for the first and second embodiments, so the description thereof is not repeated here.

FIG. 4 illustrates yet another embodiment of the present invention. FIG. 4 is a schematic depiction of an apparatus 400 for electroplating a conductive substrate with a zinc-nickel ternary or higher alloy, in accordance with another embodiment of the present invention. The apparatus 400 includes an electroplating cell 410, having a cathodic chamber 414, and a greatly reduced anodic chamber 412 which contains an conductive anodic medium 420. The apparatus 400 includes an anode 418 and the divider 416. As shown in FIG. 4, the anodic chamber 412 is defined by a divider 416, which forms a container in which the anode 418 is disposed. In this embodiment, the anode 418 and the anodic chamber 412 are separated from the cathodic chamber 414 by the divider 416. In this embodiment, the divider surrounds, and in one embodiment, forms a container around, the anode 418. In one embodiment, the divider 416 completely enclosed the anode 418. The divider 416 allows electrical current and, in some embodiments, allows selected ions to pass through the divider 416, but prevents the passage of other ions and molecules. The divider 416 may be formed of any of the divider materials disclosed above with regard to the first embodiment.

As noted with respect to the first and second embodiments, in accordance with one embodiment of the invention, the anode 418 may be formed of any of the materials disclosed above for the anodes.

As noted with respect to the first and second embodiments, in this fourth embodiment, the electroplating bath 424 in the cathodic chamber 414 contains one or more organic or inorganic species which would oxidize if in the conductive anodic medium 420. The same description applies to this fourth embodiment, but is not repeated here for brevity.

Other elements of the electroplating cell 410 of this embodiment are substantially the same as described for the first, second and third embodiments, so the description thereof is not repeated here.

FIG. 5 is an enlarged view of the container formed by the divider 416, and which surrounds the anode 418 of an embodiment similar to that shown in FIG. 4. As shown in FIG. 5, the anodic chamber 412 is defined by a divider 416, which forms the container which holds the conductive anodic medium 420 and in which the anode 418 is disposed.

As shown in FIG. 4, the container formed by the divider 416, as with the divider 116, for example, separates the anode 418 and the conductive anodic medium 420 from the electroplating bath 424. Thus, in one embodiment, the upper edges of the container formed by the divider 416 extend above the liquid level of the electroplating bath 424. In another embodiment, not shown, the container formed by the divider 416 may completely enclose the anode 418 and the conductive anodic medium 420. In this latter embodiment, the sides of the container formed by the divider 416 would extend above the anode 418 and completely enclose it. In this embodiment, the anode 418 and the container formed by the divider 416 could be submerged in the electroplating bath 424.

Test Methods

Composition and thickness of the electroplated zinc-nickel ternary or higher alloy is determined by using x-ray fluorescence (XRF) to examine panels prepared using a Hull cell. Efficiency is determined by comparing thickness at various currents or by comparing the weight gain of a panel prior to and subsequent to electrodeposition for panels that have similar total amp seconds of applied current and comparing that to the theoretical thickness or weight gain using Faraday's law. Throwing power is determined by measuring the relative coating weight gains for two cathodes placed on either side of a central anode but at varying distances (e.g., by use of a Haring Blum cell). Crystallographic phase and preferred orientation is determined by using an x-ray powder diffractometer (XRPD) preferably equipped with multiple axis capability. Bendability is measured both as elongation and as compressive decohesion. Elongation is determined by use of a cylindrical mandrel test (e.g. ISO 8401 paragraph 4.4), focuses upon effects of bending on the alloy coating on the outside of the bend, and is generally expressed as percent elongation. Compressive decohesion also is determined by use of a cylindrical mandrel test, but focuses upon effects of bending on the alloy coating on the inside of the bend, and is carried out according to the method described in Hu, M. S. and Evans, A. G., "The cracking and decohesion of thin films on ductile substrates", *Acta Metal.* 37, 3 (917-925) 1989. Residual stress is determined by use of a an XRPD to measure peak broadening and incorporating Poisson's ratio into a calculation. Poisson's ratio is estimated by determining the reduced modulus using nanoindentation (Hysitron). Brightness is determined by visual observation. Smoothness is determined by measuring the root mean square (RMS) vertical deflection of the deposit with an atomic force microscope (AFM).

Elemental composition of the coating may be determined with EDS and/or PIXE spectroscopy, both of which are forms of XRF. X-ray photoelectron spectroscopy (XPS) may be used to determine oxidation state of deposited elements. The detection limit of EDS is at about 1 atomic percent (at %). The detection limit of XPS is about 0.1 at %. The detection limit of PIXE is about 15-20 ppm. Of course, as is known, the detection limits for the methods vary somewhat depending on the exact species being detected and on other factors known in the art.

In one embodiment, Te in the alloy at its detection limit by PIXE provides the benefit(s) of its presence, including one or more of improvement of bendability, decrease in initial Ni concentration, smaller grain size and decreased hardness. In one embodiment, the presence of Te in the electroplating bath does decrease plating efficiency to some extent, but at the same time it improves throwing power.

In one embodiment, Bi in the alloy at its detection limit by XPS provides the benefit(s) of its presence, including one or more of improvement of bendability, ductility, reduced initial Ni content in the alloy and, at higher concentrations, as a brightener. In one embodiment, the presence of Bi in the electroplating bath does decrease plating efficiency to some extent, but at the same time it improves throwing power.

In one embodiment, Sb in the alloy at its detection limit by XPS provides the benefit(s) of its presence, including one or more of improvement of bendability, ductility, decreased grain size. In one embodiment, the presence of Sb in the electroplating bath does decrease plating efficiency to some extent, but at the same time it improves throwing power.

Each of Te, Bi and Sb, when present, contribute to a reduction in hardness of the alloy. Hardness may be measured by standard techniques, such as by Vickers or Knoop hardness. Knoop hardness measures the hardness of a material by the penetration depth of a diamond stylus under a specified amount of pressure, and is commonly expressed in $Kg/mm^2$. Vickers hardness is determined in a test similar to the Knoop hardness test and is expressed in the same units.

Thus, in some embodiments, the minimum detectable amount of these ions bestow the benefits of their presence on the zinc-nickel ternary or higher alloy.

Initial nickel concentration refers to the amount of nucleate nickel deposited during the first 5-20 seconds of electrodeposition of a zinc-nickel alloy, including the zinc-nickel ternary or higher alloys of the present invention. When initial nickel is high, an undesirable crystal structure of the deposited alloy, or other undesirable effects, may be obtained. Initial nickel is measured by XPS.

Morphology, especially of the initial nucleate stages of deposition, may be examined using a cold cathode field emission scanning electron microscopy (SEM). Grain size variations of the coatings may be observed by preparing polished metallographic cross sections and subjecting them to ion bombardment using an argon ion beam while the samples are uniformly rotated in a vacuum chamber (Zalar rotation). The resulting argon ion etched cross sections are examined using the cold cathode field emission SEM.

Haring Blum panels, uniform current density coupons, and Hull cell panels may be used to evaluate the composition and properties of coatings obtained from various electrolytes with and without addition agents. Haring Blum panels (e.g., at 2.5 A current for 30 minutes) may be used to obtain information on throwing power and relative deposition efficiency. Constant current density (28 amps per square foot (ASF) for 20 minutes) coupons may be subjected to bendability and compressive decohesion testing, micro-hardness and modulus determination testing and in many cases X-ray diffraction. Haring Blum, constant current density and Hull Cell panels may be used to determine elemental composition and morphology.

All of the important material properties are generally thought to be dependent upon the arrangement of atoms within the deposited ZnNi alloy. The study of the atomic arrangement of atoms is facilitated by uses of electron or x-ray diffraction techniques. X-ray diffraction, in particular, is easy to implement and provides a great deal of information about a deposit, particularly an alloy. The use of an X-ray powder diffractometer in reflectance mode can provide information on the phases present in a crystallized alloy, the preferred orientation of the crystals (which is commonly a fiber orientation with electrodeposits), and the texture of the deposit. For zinc nickel alloys a variety of phases are possible. A hexagonal zinc phase (ICDD 87-0713), a cubic gamma phase (ICDD 06-0653, nominal composition $Ni_5Zn_{21}$) and a tetragonal delta phase (ICDD 10-0209 nominal composition $Ni_3Zn_{22}$) have all been reported in the literature on electrodeposited ZnNi.

The use of a Haring Blum cell is reviewed by McCormic and Kuhn (*Metal Finish.*, 72 (2), (74) 1993) and by Gabe in the *Metal Finishing Guidebook and Directory* (1998, pp. 566). With this apparatus two cathodic panels are simultaneously plated using a single anode, usually made from a mesh material, placed between the two cathodes. The resulting geometry produces two separate cells with very similar symmetric current and potential distribution. The three electrodes are arranged so that differing lengths between the anode and the two cathodes are present. Various formulae may be used to calculate throwing power. All the formulae have in common the use of the ratio of the mass gain of the two cathodic panels and the ratio of the length between the two cathodic panels and the anode. In one embodiment, the Haring formula for throwing power may be used, which is % TP=100 (L−R)/L, where L is the far-to-near cathode distance ratio and R is the ratio of the weights gained by the cathodic panels.

In one embodiment, the sum of the weight gain from the two coupons may be used to compare deposition efficiency, at similar current densities, between electrolytes. By recording the current and time used to plate the Haring Blum panels, measuring the resulting alloy composition, and calculating the theoretical mass gain for an alloy of identical composition we can obtain an estimate of plating efficiency by the ratio observed mass gain to theoretical mass gain. The theoretical mass gain, $M_{theor}$, is calculated from a formula such as $$M_{theor}=I\cdot t/60\cdot\Sigma A_i g_i,$$

where I is the current, t is plating time in minutes, $A_i$ is the atomic percentage of element i in the resulting deposit, $g_i$ is the electrochemical equivalent of the specific element in grams of element i that can be deposited in one amp hour, derived from Faraday's law, and tabulated in numerous references such as Schlesinger and Paunovic, Modern Electroplating, 4th ed., Appendix Table 4 (2000). For example, a 15 atomic percent nickel balance zinc deposit obtained by plating Haring Blum cathodes for 2A and 30 minutes has a theoretical mass of 1.2004 grams based upon 1.095 g/Ahr and 1.219 g/Ahr electrochemical equivalents for nickel and zinc respectively. If the combined weight gain of the two panels is 0.6 grams, the calculated efficiency is 0.6/1.2004*100% or ~50%.

Bendability testing is done in accordance with the procedure described in International Standard 8401 "Metallic coatings—Review of methods of measurement of ductility", chapter 4.4, Cylindrical Mandrel Testing. Essentially this consists of bending 2.5×10 cm coupons, with electroplated surfaces toward the exterior of the bend, around cylindrical mandrels of varying diameter and noting the diameter at which cracking is observed at 10× magnification. By use of the equation $\% E=T_{tot}/(d+T_{tot})*100$ the percent elongation of the coating is determined (where $T_{tot}$ is the thickness of the substrate plus the thickness of the coating and d is the diameter of the mandrel) and recorded. Compressive decohesion is observed by bending similar coupons, in this case with the plated surface toward the cylindrical mandrel, around varying diameters of cylindrical mandrels and again observing cracking. For compressive decohesion an easy to use equation is not available but the observation of the type of compressive decohesion may be made. If there are a multiplicity of cracks with no evidence of delamination from the substrate the observation of a diffuse microcracking at the observed diameter is made. If there are only a few cracks and it is evident that some of the coating is not adhering to substrate the observation of concentrated decohesion at the observed diameter is made. This later observation should be considered a significant failure of the coating at the observed bend radius.

EXAMPLES

The following examples illustrate the electroplating baths of the invention. The amounts of the components in the following examples are in mol/dm$^3$ (mole/liter). Unless otherwise indicated in the specification and claims, all parts and percentages are by weight (or atomic %), temperatures are in degrees centigrade, and pressures are at or near atmospheric pressure.

Electrolytes:

In the examples, four different alkaline electrolytes and two acid electrolytes are prepared. These electrolytes are used with various combinations of alloying metals in accordance with embodiments of the invention, or without such alloying metals, or with dividers in the bath in accordance with embodiments of the invention, without such dividers, in comparative examples.

| Electrolyte one (E1): | |
|---|---|
| ZnO | 0.16 mol/dm$^3$ |
| Triethanolamine (TEA) | 0.02 mol/dm$^3$ |
| 1,2-ethanediamine,N-(2-aminoethyl)-(DETA) | 0.10 mol/dm$^3$ |
| $NiSO_4 \cdot 6H_2O$ | 0.017 mol/dm$^3$ |
| Quadrol | 0.13 mol/dm$^3$ |
| NaOH | 2.99 mol/dm$^3$ |

-continued

| Electrolyte two (E2): | |
|---|---|
| ZnO | 0.13 mol/dm$^3$ |
| TEA | 0.02 mol/dm$^3$ |
| DETA | 0.08 mol/dm$^3$ |
| $NiSO_4 \cdot 6H_2O$ | 0.014 mol/dm$^3$ |
| Quadrol | 0.10 mol/dm$^3$ |
| NaOH | 2.77 mol/dm$^3$ |
| Electrolyte three (E3): | |
| ZnO | 0.15 mol/dm$^3$ |
| Tetraethylenepentamine (TEPA) | 0.11 mol/dm$^3$ |
| TEA | 0.04 mol/dm$^3$ |
| $NiSO_4 \cdot 6H_2O$ | 0.026 mol/dm$^3$ |
| Quadrol | 0.04 mol/dm$^3$ |
| NaOH | 3.14 mol/dm$^3$ |
| Electrolyte four (E4): | |
| $ZnSO_4 \cdot H_2O$ | 0.20 mol/dm$^3$ |
| $Na_2SO_4$ | 0.50 mol/dm$^3$ |
| $NiSO_4 \cdot 6H_2O$ | 0.50 mol/dm$^3$ |
| Electrolyte five (E5) | |
| $ZnSO_4 \cdot H_2O$ | 0.20 mol/dm$^3$ |
| $Na_2SO_4$ | 0.18 mol/dm$^3$ |
| $NiSO_4 \cdot 6H_2O$ | 0.59 mol/dm$^3$ |
| $H_3BO_3$ | 0.65 mol/dm$^3$ |
| Zylite HT MU | 50 ml/liter |
| Sodium Citrate | 0.39 mol/dm$^3$ |
| Ascorbic acid | 0.23 mol/dm$^3$ |
| HCl | to pH 1 |
| Electrolyte six (E6): | |
| $ZnSO_4 \cdot H_2O$ | 0.17 mol/dm$^3$ |
| $NiSO_4 \cdot 6H_2O$ | 0.03 mol/dm$^3$ |
| Sodium Citrate | 0.77 mol/dm$^3$ |
| $NH_4Cl$ | 0.99 mol/dm$^3$ |
| NaOH | to pH 12 |
| Electrolyte seven (E7): | |
| $NiSO_4 \cdot 6H_2O$ | 0.03 mol/dm$^3$ |
| $ZnCl_2$ | 0.40 mol/dm$^3$ |
| Citric Acid | 0.50 mol/dm$^3$ |
| $NH_4Cl$ | 0.75 mol/dm$^3$ |
| Quadrol | 0.11 mol/dm$^3$ |
| Mirapol A15 | 0.012 mol/dm$^3$ |
| Electrolyte eight (E8): | |
| $NiSO_4 \cdot 6H_2O$ | 0.017 mol/dm$^3$ |
| $ZnSO_4 \cdot 6H_2O$ | 0.37 mol/dm$^3$ |
| Citric Acid | 0.05 mol/dm$^3$ |
| Methane Sulfonic Acid (MSA) | 2.1 mol/dm$^3$ |

Elements for Alloying with Zinc and Nickel

In accordance with the present invention, the electroplating bath of the present invention, in addition to zinc ions and nickel ions, further comprises one or more additional ionic species corresponding to elements selected from Te, Bi, Sb, Ag, Cd, Co, Cr, Cu, Fe, In, Mn, Mo, P, Sn and W. As will be understood, additional elements may be included in such an alloy. For example, along with zinc, nickel, tellurium and copper, another element, such as tin (Sn) may be included to form a zinc-nickel canaria alloy. Similarly, four elements may be added to the zinc-nickel alloy forming a zinc-nickel sentry alloy, and five elements may be added to form a zinc-nickel septenary alloy. Higher alloys may also be formed. In one embodiment, however, the present invention is primarily directed to zinc-nickel ternary and higher alloys including zinc, nickel and one or more elements corresponding to one or more of the above-noted one or more additional elements selected from Te, Bi, Sb, Ag, Cd, Co, Cr, Cu, Fe, In, Mn, Mo, P, Sn and W.

Table I presents exemplary data on elements which may be used in zinc-nickel ternary and higher alloys in accordance with various embodiments of the invention, including sources, benefits, exemplary alkaline bath concentration and exemplary alloy content. Similar sources, benefits, concentration and content ranges are applicable to various embodiments of the invention employing acid baths. The information in this Table I is exemplary and is not intended to limit the scope of the invention, which is limited only by the scope of the appended claims.

TABLE I

| Ion | Exemplary Benefits | Exemplary Source 1 | Exemplary Source 2 | Exemplary Bath Conc. | Exemplary Alloy Conc. |
|---|---|---|---|---|---|
| $Bi^{+3}$ | reduce initial Ni content; improves bendability of bulk deposit | $Bi_2O_3$ in gluconic acid/$H_2O_2$ | bismuth salicylate | ~0.2 to ~2 g/l | ~0.1 to ~2 at % |
| $TeO_3^{-2}$ ($Te^{+4}$) | reduce initial Ni content; improves bendability of bulk deposit | $Na_2TeO_3$ | $K_2TeO_3$ | ~0.02 to ~1 g/l | ~10 ppm to ~1 at % as Te |
| $Sb^{+3}$ | reduce initial Ni content; improves bendability of bulk deposit | K(SbO)—$C_4H_4O_8$•3 $H_2O$ | — | ~0.1 to ~3 g/l | ~0.1 to ~2 at % |
| $Ag^{+1}$ | as solder replacement | $Ag_2SO_4$ | $AgNO_3$ | ~10 to ~50 g/l | ~0.5 to ~3 at % |
| $Cd^{+2}$ | decreases H embrittlement | $CdCl_2$ | CdO | ~0.1 to ~5 g/l | ~0.5 to ~2 at % |
| $Co^{+2}$ | reduces gray veil | $CoSO_4$ | $CoCl_2$ | ~1 to ~50 g/l | ~0.5 to ~10 at % |
| $Cr^{+3}$ | increases hardness | $CrCl_3$ | $Cr_2O_3$ | ~1 to ~50 g/l | ~0.5 to ~6 at % |
| $Cu^{+2}$ | as strike layer | $CuSO_4$ | $CuCl_2$ | ~0.1 to ~100 g/l | ~0.5 to ~30 at % |
| $Fe^{+2}$ | ZnNiFe alloy treated w/ $H_3PO_4$ creates paintable surface | $FeCl_2$ | $FeSO_4$ | ~1 to ~10 g/l | ~0.5 to ~20 at % |
| $In^{+3}$ | improves ductility | $InCl_3$ | $In_2(SO_4)_3$ | ~1 to ~100 g/l | ~0.5 to ~6 at % |
| $Mn^{+2}$ | increases nobility of deposit and/or slows corrosion rate | $MnSO_4$ | $MnCl_2$ | ~1 to ~100 g/l | ~0.5 to ~6 at % |
| $Mo^{+6}$ | increases hardness | $Na_2MoO_4$ | — | ~1 to ~100 g/l | ~0.5 to ~6 at % |
| $P^{+3}$ (as $H_2PO_2^{-1}$) | increases nobility of deposit; can use to "phosphatize" | $NaH_2PO_2$ | $H_3PO_2$ | ~1 to ~100 g/l | ~0.5 to ~20 at % as P |
| $Sn^{+2}$ | increases ductility & nobility | $SnCl_2$ | $SnSO_4$ | 1–50 g/l | ~0.5 to ~6 at % |
| $W^{+6}$ | increases hardness | $Na_2WO_4$ | — | 5–10 g/l | ~0.1 to ~1 at % |

Table II presents information relating to certain embodiments of the elements for alloying with zinc and nickel in accordance with embodiments of the present invention. The indicated sources, concentration in bath, concentration in limit the scope of the invention, which is limited only by the scope of the appended claims.

TABLE II

| Example | Electrolyte | Alloying Element(s) | Conditions | Elongation | Remarks |
|---|---|---|---|---|---|
| 1 | E1 | None | | <1% | Control, no ternary alloy; Er ~125.6 GPa. |
| 2 | E2 | Te | 3 ml/l 2% $Na_2TeO_3$ w/o membrane | >3% | Te initially detectable by PIXE, % E >3%, Er ~100.14 GPa; but after 10 Ahr/l Te is not detectable in deposit, % E <1%, Er ~140.4 GPa. |
| 3 | E2 | Te | same as Ex. 2 + NAFION ® cationic membrane | >3% | Same initial results; and Te remains detectable after 10 Ahr/l and Er ~99 GPa. |
| 4 | E2 | Te | same as Ex. 2 + NAFION ® anionic membrane | >3% | Same initial results; and Te remains detectable after 10 Ahr/l and Er ~102 GPa. |
| 5 | E2 | Sb | 3.6 ml/l 10% K(SbO)—$C_4H_4O_8$•3 $H_2O$ w/o membrane | >3% | Sb initially detectable by PIXE and XPS, % E >3%; but after 10 Ahr/l Sb is not detectable in deposit and % E <1%. |
| 6 | E2 | Sb | same as Ex. 5 + NAFION ® anionic membrane | >3% initial, >6% after 10 Ahr/l | Same initial results, Er ~103 GPa; Sb remains detectable after 10 Ahr/l. |
| 7 | E1 | Bi | 3 ml/l 8.1% $Bi_2O_3$ (note 1) | <1% | Bi initially detectable by PIXE and XPS, % E >3%; but after 20 Ahr/l Bi is not detectable in deposit. |

TABLE II-continued

| Example | Electrolyte | Alloying Element(s) | Conditions | Elongation | Remarks |
|---|---|---|---|---|---|
| 8 | E1 | Bi | same as Ex.7 + NAFION ® anionic membrane | >3% | Same initial results; and Bi remains detectable after 20 Ahr/l with membrane. |
| 9 | E2 | Co | 1 g/l $CoSO_4$ (note 2) | <1% | Co ~1.4 wt % in alloy by EDS; NSS shows less gray veil than from E2 with no Co. |
| 10 | E2 | Co, Te | same as Ex. 9 + 3 ml/l 2% $Na_2TeO_3$ | >3% | Co ~1.4 wt % detectable in alloy by EDS; Te detectable by PIXE; NSS shows less gray veil than from E2 with no Co. |
| 11 | E1 | Fe | 5 g/l $FeSO_4$ (note 3) | decreased re: no Fe | In both, 2-4 at % Fe in alloy by EDS; % E reduced compared to no Fe; but when treat alloy with $H_3PO_4$, dry, rinse, paint, scribe, (creep test) better than with no Fe; better paint receptivity. |
| 12 | E1 | Fe, Te | same as Ex. 11 + 3 ml/l 2% $Na_2TeO_3$ | similar to ZnNi w/o Fe | When Te present, % E similar to ZnNi alloy w/o Fe. |
| 13a | E3 | Co, Te | same as Ex. 9 + 3 ml/l 2% $Na_2TeO_3$ w/o membrane | >3% initial | After 10 Ahr/l without anionic membrane, E <1%. |
| 13b | E3 | Co, Te | same as Ex. 13a + anionic membrane | >3% | After 10 Ahr/l with anionic membrane, E >3%. |
| 14a | E3 | Co, Sb | 1 g/l $CoSO_4$ + 3.6 ml/l 10% K(SbO)—$C_4H_4O_8$•3 $H_2O$ (note 2) w/o membrane | >3% initial | Sb remains detectable by PIXE after 10 Ahr/l with anionic membrane After 10 Ahr/l without anionic membrane, E <1% and Sb is not detectable by PIXE. |
| 14b | E3 | Co, Sb | same as Ex. 14a + anionic membrane | >3% | After 10 Ahr/l with anionic membrane, E >3%. |
| 15 | E4 | P | 15 g/l $NaH_2PO_2$ w/o membrane | <1% | P detected by EDS; brittle; after ~20 Ahr/l, ppt. of $Zn(PO_3)$ and/or $Zn(PO_4)$ observed. |
| 16a | E4 | P, Te | same as Ex. 15 + 3 ml/l 2% $Na_2TeO_3$ w/o membrane | ~3% | P detected by EDS; less brittle when Te in deposit; still formed ppt. after ~20 Ahr/l. |
| 16b | E4 | P, Te | same as Ex. 16a w/ cationic membrane around Ni anode | ~3% | P detected by EDS; less brittle when Te in deposit; no evidence of ppt. even after ~20 Ahr/l. |
| 17 | E5 | Mn | $Mn^{+2}$ (as $MnSO_4$) at 0.43 mol/$dm^3$ | | Example of ZnNiMn. |
| 18 | E6 | P | 15 g/1 $NaH_2PO_2$ | | Example of alkaline ZnNiP. |
| 19 | E4 | Cd | $CdSO_4$, 1 g/l | | Example of ZnNiCd. |
| 20 | E7 | Sn, P | $SnCl_2$, 0.09 m/$dm^3$, $NaH_2PO_2$, 0.23 m/$dm^3$, w/ and w/o membrane | | Example of ZnNiSnP; in weight ratio 79.7:4.4:15.2:0.7 at % (same order). |
| 21 | E3 | W | 5 g/l $Na_2WO_4$ | | W detectable in deposit by EDS. |
| 22 | E1 | Cr | 10 g/l $Cr_2O_3$, reflux in bath until no $Cr^{+6}$ | | Example of ZnNiCr; Cr detectable in deposit by EDS. |
| 23 | E4 | none | cylindrical cathode, rotate @ 500 rpm | | Very brittle deposit; test is to simulate high speed strip plating; current density 80 ASF, 5 min. |
| 24 | E4 | Te | same as Ex. 23 + 10 ml/l 2% $Na_2TeO_3$ | ~2% | Less brittle deposit. |
| 25 | E8 | Ag | AgMSA 0.1 m/$dm^3$ (note 4) | | Example of ZnNiAg, in weight ratio 70:10:20 (same order). |
| 26 | 1 | Cu | $CuSO_4$, 1 g/l | | Example of ZnNiCu; in weight ratio 66.7:5.6:27.7 at % (same order). |

note 1: 3 ml/l 8.1% $Bi_2O_3$, 12% KOH, 23% gluconic acid and 4% $H_2O_2$ in water.
note 2: 1 g/l $CoSO_4$, 5.3 g/l DETA and 1.8 g/l TEA.
note 3: 5 g/l $FeSO_4$, 10.7 g/l TEA and 23 ml/l additional water to thin slurry
note 4: AgMSA 0.1 mol/$dm^3$ from 4:1 molar mixture (63:40.3 g) PTI:AgMSA 50%. PTI = 1-methyl-3-propyl-imidazole-2-thione.

As described in the foregoing, the present invention relates to an electroplating bath, an electroplating system, and an electroplating process for forming a zinc-nickel ternary or higher alloy on a metal or electrically conductive surface. While the invention is primarily adapted for use with metal or metallic surfaces, it should be understood that any conductive surface may be treated in accordance with the present invention. The foregoing description refers to a metal surface, but it should be understood that as used herein, the term"metal surface" includes generally conductive surfaces, be the surface metal, metallic, polymeric coated with metal, carbon or graphite, or other conductive material, such as a conductive polymer. The term"metal surface" as used herein includes a wide range of metal surfaces such as steel, silicon containing steel, iron and iron alloys, zinc, copper, lead, metallized ceramics and plastics, conductive polymers, carbon and graphite, among other metals and alloys thereof. The metal-containing surface may also include naturally occurring or man-made oxidation and reduction products, e.g., $Fe_3O_4$, $Fe_2O_3$, among others.

While the invention has been explained in relation to various of its embodiments, it is to be understood that various modifications thereof will become apparent to those of skill in the art upon reading the foregoing specification and following claims. Therefore, it is to be understood that the invention disclosed herein is intended to cover such modifications as fall within the scope of the appended claims.

What is claimed is:

1. An electroplating bath for depositing a zinc-nickel ternary or higher alloy, comprising:

a) zinc ions, wherein the zinc ions are present in the bath as one or more of ZnO, $Zn(OH)_2$, $Zn(Cl)_2$, $ZnSO_4$, $ZnCO_3$, $Zn(SO_3NH_2)_2$, $Zn(OOCCH_3)_2$, $Zn(BF_4)_2$ and zinc methane sulfonate;

b) nickel ions, wherein the nickel ions are present in the bath as one or more of $NiSO_4$, $NiSO_4.6H_2O$, $NiCO_3$, $Ni(SO_3NH_2)_2$, $Ni(OOCCH_3)_2$, $(NH_2)_2Ni(SO_4)_2$, $Ni(OOCH)_2$, a Ni complex, $Ni(BF_4)_2$ and nickel methane sulfonate;

c) from about 0.01 g/dm$^3$ to about 10 g/dm$^3$ of one or more ionic species selected from ions of $Te^{+4}$, $Bi^{+3}$ and $Sb^{+3}$, with the proviso that when the ionic species comprises $Te^{+4}$, the bath further comprises one or more additional ionic species selected from ions of $Bi^{+3}$, $Sb^{+3}$, $Ag^{+1}$, $Cd^{+2}$, $Co^{+2}$, $Cr^{+3}$, $Cu^{+2}$, $Fe^{+2}$, $In^{+3}$, $Mn^{+2}$, $Mo^{+6}$, $P^{+3}$, $Sn^{+2}$ and $W^{+6}$; and d) one or more non-ionogenic surface active polyoxyalkylene compound, and further comprising ethylenediamine or its methyl-substituted derivatives; propylenediamine or its methyl-substituted derivatives; diethylenetriamine or its methyl-substituted derivatives; or a polymer of an aliphatic amine.

2. The bath of claim 1 wherein when the ionic species comprises one or more of $Bi^{+3}$ or $Sb^{+3}$, the bath further comprises one or more additional ionic species selected from ions of $Ag^{+1}$, $Cd^{+2}$, $Co^{+2}$, $Cr^{+3}$, $Cu^{+2}$, $Fe^{+2}$, $In^{+3}$, $Mn^{+2}$, $Mo^{+6}$, $P^{+6}$, $Sn^{+2}$ and $W^{+6}$.

3. The bath of claim 1 wherein the zinc ions and the nickel ions are present in the bath at concentrations sufficient to deposit the alloy, wherein the alloy comprises a nickel content from about 3 wt % to about 25 wt % of the alloy.

4. The bath of claim 1 wherein the zinc ions and the nickel ions are present in the bath at concentrations sufficient to deposit the alloy, wherein the alloy comprises a nickel content from about 8 wt % to about 22 wt % of the alloy.

5. The bath of claim 1 wherein the concentration of $Bi^{+3}$ is in the range from 0.2 to 2 g/dm$^3$.

6. The bath of claim 1 wherein the one or more non-ionogenic surface active polyoxyalkylene compound comprises:

(i) at least one compound having a formula:

$$R^1—O—[(CH_2)_nO]_xH \quad \text{(Ia)}$$

or $$R^1—O—[(CHR^2CH_2)O]_xH \quad \text{(Ib)}$$

or $$R^1—O—[(CH_2CHR^2)O]_xH \quad \text{(Ic)}$$

wherein $R^1$ is an aryl or alkyl group containing up to about 24 carbon atoms, $R^2$ is an alkyl group containing from 1 to about 4 carbon atoms, n is 2 or 3, and x is an integer between 2 and about 100;

(ii) at least one compound having a formula:

$$R^3—O—[R^4—O—]_n—X \quad \text{(IIa)}$$

or $$(R^3—O—[R^4—O—]_n)_a—Y \quad \text{(IIb)}$$

wherein $R^3$=a $C_1$-$C_{18}$ branched or unbranched alkyl, alkylene or alkynyl group, or phenyl-O—$[R^5—O—]_m—CH_2$—, in which m=0-100, n is 2 or 3 and $R^5$ is a $C_1$-$C_4$ branched or unbranched alkylene $R^4$=a $C_1$-$C_4$ branched or unbranched alkylene; X=H, —$NH_2$, —Cl, —Br, —$SO_2Z$, —$SO_3Z$, —$SO_4Z$, —$PO_3Z_2$, or —$PO_4Z_2$, wherein Z independently is one or more of H and an alkali metal ion, or $Z_2$ is an alkaline earth metal ion; Y is an aliphatic polyhydroxy group, an amine group, a polyamine group or a mercaptan group, and a is equal to or less than the number of active hydrogens in OH, —NH, —$NH_2$ or —SH groups on the Y component; or (iii) a mixture of two or more of (i) and/or (ii).

7. The bath of claim 1 wherein the bath comprises an acidic pH.

8. The bath of claim 1 wherein the bath comprises an alkaline pH.

9. The bath of claim 8 further comprising a compound represented by the formula $$R^7(R^8)N—R^{11}—N(R^9)R^{10} \quad \text{(V)}$$

wherein $R^7$, $R^8$, $R^9$ and $R^{10}$ are each independently alkyl or hydroxyalkyl groups provided that one or more of $R^7$-$R^{10}$ is a hydroxy alkyl group, and $R^{11}$ is a hydrocarbylene group containing up to about 10 carbon atoms, or a mixture of two or more thereof.

10. The bath of claim 1 wherein the concentration of $Sb^{+3}$ is in the range from 0.1 to 3 g/dm$^3$.

11. An electroplating bath for depositing a zinc-nickel ternary or higher alloy, comprising:

a) zinc ions, wherein the zinc ions are present in the bath as one or more of ZnO, $Zn(OH)_2$, $Zn(Cl)_2$, $ZnSO_4$, $ZnCO_3$, $Zn(SO_3NH_2)_2$, $Zn(OOCCH_3)_2$, Zn $(BF_4)_2$ and zinc methane sulfonate;

b) nickel ions, wherein the nickel ions are present in the bath as one or more of $NiSO_4$, $NiSO_4.6H_2O$, $NiCO_3$, $Ni(SO_3NH_2)_2$, $Ni(OOCCH_3)_2$, $(NH_2)_2Ni(SO_4)_2$, $Ni(OOCH)_2$, a Ni complex, $Ni(BF_4)_2$ and nickel methane sulfonate;

c) from about 0.01 g/dm$^3$ to about 10 g/dm$^3$ of one or more ionic species selected from ions of $Te^{+4}$, $Bi^{+3}$ and $Sb^{+3}$, and d) one or more non-ionogenic surface active polyoxyalkylene compound, with the proviso that when the ionic species comprises $Te^{+4}$, the bath is free of a mixture of brighteners comprising both (i) reaction product of epihalohydrin with an alkylene amine, and (ii) aromatic aldehydes, and further comprising ethylenediamine or its methyl-substituted derivatives; propylenediamine or its methyl-substituted derivatives; diethylenetriamine or its methyl-substituted derivatives; or a polymer of an aliphatic amine.

12. The bath of claim 11 wherein the bath further comprises one or more additional ionic species selected from ions of $Ag^{+1}$, $Cd^{+2}$, $Co^{+2}$, $Cr^{+3}$, $Cu^{+2}$, $Fe^2$, $In^{+3}$, $Mn^{+2}$, $Mo^{+6}$, $P^{+3}$, $Sn^{+2}$ and $W^{+6}$.

13. The bath of claim 11 wherein the zinc ions and the nickel ions are present in the bath at concentrations sufficient to deposit the alloy wherein the alloy comprises a nickel content from about 3 wt % to about 25 wt % of the alloy.

14. The bath of claim 11 wherein the zinc ions and the nickel ions are present in the bath at concentrations sufficient to deposit the alloy, wherein the alloy comprises a nickel content from about 8 wt % to about 22 wt % of the alloy.

15. The bath of claim 11 wherein the concentration of $Bi^{+3}$ is in the range from 0.2 to 2 g/dm$^3$.

16. The bath of claim 11 wherein the concentration of $Sb^{+3}$ is in the range from 0.1 to 3 g/dm$^3$.

17. The bath of claim 11 wherein the one or more non-ionogenic surface active polyoxyalkylene compound comprises:

(i) at least one compound having a formula:

$$R^1—O—[(CH_2)_nO]_xH \quad \text{(Ia)}$$

or $$R^1—O—[(CHR^2CH_2)O]_xH \quad \text{(Ib)}$$

or $$R^1—O—[(CH_2CHR^2)O]_xH \quad \text{(Ic)}$$

wherein $R^1$ is an aryl or alkyl group containing up to about 24 carbon atoms, $R^2$ is an alkyl group containing from 1 to about 4 carbon atoms, n is 2 or 3, and x is an integer between 2 and about 100;

(ii) at least one compound having a formula:

$$R^3—O—[R^4—O—]_n—X \quad \text{(IIa)}$$

or $$(R^3—O—[R^4—O—]_n)_a—Y \quad \text{(IIb)}$$

wherein $R^3$=a $C_1$-$C_{18}$ branched or unbranched alkyl, alkylene or alkynyl group, or phenyl-O—$[R^5—O—]_m$—$CH_2$—, in which m=0-100, n is 2 or 3 and $R^5$ is a $C_1$-$C_4$ branched or unbranched alkylene; $R^4$=$C_1$-$C_4$ branched or unbranched alkylene; X=H, —$NH_2$, —Cl, —Br, —$SO_2Z$, —$SO_3Z$, —$SO_4Z$, —$PO_3Z_2$, or —$PO_4Z_2$, wherein Z independently is one or more of H and an alkali metal ion, or $Z_2$ is an alkaline earth metal ion; Y is an aliphatic polyhydroxy group, an amine group, a polyamine group or a mercaptan group, and a is equal to or less than the number of active hydrogens in OH, —NH, —$NH_2$ or —SH groups on the Y component; or (iii) a mixture of two or more of (i) and/or (ii).

18. The bath of claim 11 wherein the bath comprises an acidic pH.

19. The bath of claim 11 wherein the bath comprises an alkaline pH.

20. The bath of claim 19 further comprising a compound represented by the formula $$R^7(R^8)N—R^{11}—N(R^9)R^{10} \quad \text{(V)}$$

wherein $R^7$, $R^8$, $R^9$ and $R^{10}$ are each independently alkyl or hydroxyalkyl groups provided that one or more of $R^7$-$R^{10}$ is a hydroxy alkyl group, and $R^{11}$ is a hydrocarbylene group containing up to about 10 carbon atoms, or a mixture of two or more thereof.

21. An electroplating bath for depositing a zinc-nickel quaternary or higher alloy, comprising:

a) zinc ions, wherein the zinc ions are present in the bath as one or more of ZnO, $Zn(OH)_2$, $Zn(Cl)_2$, $ZnSO_4$, $ZnCO_3$, $Zn(SO_3NH_2)_2$, $Zn(OOCCH_3)_2$, $Zn(BF_4)_2$ and zinc methane sulfonate;

b) nickel ions, wherein the nickel ions are present in the bath as one or more of $NiSO_4$, $NiSO_4.6H_2O$, $NiCO_3$, $Ni(SO_3NH_2)_2$, $Ni(OOCCH_3)_2$, $(NH_2)_2Ni(SO_4)_2$, $Ni(OOCH)_2$, a Ni complex, $Ni(BF_4)_2$ and nickel methane sulfonate;

c) one or more ionic species selected from ions of $Te^{+4}$, $Bi^{+3}$ and $Sb^{+3}$;

d) one or more ionic species selected from ions of $Ag^{+1}$, $Cd^{+2}$, $Co^{+2}$, $Cr^{+3}$, $Cu^{+2}Fe^{+2}$, $In^{+3}$, $Mn^{+2}$, $Mo^{+6}$, $P^{+3}$, $Sn^{+2}$ and $W^{+6}$; and e) one or more non-ionogenic surface active polyoxyalkylene compound, and further comprising ethylenediamine or its methyl-substituted derivatives; propylenediamine or its methyl-substituted derivatives; diethylenetriamine or its methyl-substituted derivatives; or a polymer of an aliphatic amine.

22. The bath of claim 21 wherein the zinc ions and the nickel ions are present in the bath at concentrations sufficient to deposit the alloy, wherein the alloy comprises a nickel content from about 3 wt % to about 25 wt % of the alloy.

23. The bath of claim 21 wherein the zinc ions and the nickel ions are present in the bath at concentrations sufficient to deposit the alloy, wherein the alloy comprises a nickel content from about 8 wt % to about 22 wt % of the alloy.

24. The bath of claim 21 wherein the concentration of $Bi^{+3}$ is in the range from 0.2 to 2 g/dm$^3$.

25. The bath of claim 21 wherein the concentration of $Sb^{+3}$, is in the range from 0.1 to 3 g/dm$^3$.

26. The bath of claim 21 wherein the one or more non-ionogenic surface active polyoxyalkylene compound comprises:

(i) at least one compound having a formula:

$$R^1—O—[(CH_2)_nO]_xH \quad \text{(Ia)}$$

or $$R^1—O—[(CHR^2CH_2)O]_xH \quad \text{(Ib)}$$

or $$R^1—O—[(CH_2CHR^2)O]_xH \quad \text{(Ic)}$$

wherein $R^1$ is an aryl or alkyl group containing up to about 24 carbon atoms, $R^2$ is an alkyl group containing from 1 to about 4 carbon atoms, n is 2 or 3, and x is an integer between 2 and about 100;

(ii) at least one compound having a formula:

$$R^3—O—[R^4—O—]_n—X \quad \text{(IIa)}$$

or $$(R^3—O—[R^4—O—]_n)_a—Y \quad \text{(IIb)}$$

wherein $R^3$=a $C_1$-$C_{18}$ branched or unbranched alkyl, alkylene or alkynyl group, or phenyl-O—$[R^5—O—]_m$—$CH_2$—, in which m=0-100, n is 2 or 3 and $R^5$ is a $C_1$-$C_4$ branched or unbranched alkylene; $R^4$=$C_1$-$C_4$ branched or unbranched alkylene; X=H, —$NH_2$, —Cl, —Br, —$SO_2Z$, —$SO_3Z$, —$SO_4Z$, —PO3$Z_2$, or —$PO_4Z_2$, wherein Z independently is one or more of H and an alkali metal ion, or $Z_2$ is an alkaline earth metal ion; Y is an aliphatic polyhydroxy group, an amine group, a polyamine group or a mercaptan group, and a is equal to or less than the number of active hydrogens in OH, —NH, —$NH_2$ or —SH groups on the Y component; or (iii) a mixture of two or more of (i) and/or (ii).

27. The bath of claim 21 wherein the bath comprises an acidic pH.

28. The bath of claim 21 wherein the bath comprises an alkaline pH.

29. The bath of claim 28 further comprising a compound represented by the formula $$R^7(R^8)N—R^{11}—N(R^9)R^{10} \quad \text{(V)}$$

wherein $R^7$, $R^8$, $R^9$ and $R^{10}$ are each independently alkyl or hydroxyalkyl groups provided that one or more of $R^7$-$R^{10}$ is a hydroxy alkyl group, and $R^{11}$ is a hydrocarbylene group containing up to about 10 carbon atoms, or a mixture of two or more thereof.

* * * * *

UNITED STATES PATENT AND TRADEMARK OFFICE

CERTIFICATE OF CORRECTION

PATENT NO. : 7,442,286 B2
APPLICATION NO. : 10/789175
DATED : October 28, 2008
INVENTOR(S) : Capper et al.

It is certified that error appears in the above-identified patent and that said Letters Patent is hereby corrected as shown below:

Claim 2, col. 33, line 22, $P^{+6}$ should be $P^{+3}$

Claim 21, col. 35, line 50, $Cu^{+2}Fe^{+2}$ should be $Cu^{+2}$, $Fe^{+2}$

Claim 26, col. 36, line 39, $PO3Z_2$ should be $PO_3Z_2$

Signed and Sealed this

Seventh Day of December, 2010

David J. Kappos

David J. Kappos
*Director of the United States Patent and Trademark Office*